US007581896B2

(12) United States Patent
Yoon

(10) Patent No.: US 7,581,896 B2
(45) Date of Patent: Sep. 1, 2009

(54) SAFETY KNOCK-TYPE WRITING INSTRUMENT

(75) Inventor: Hyun-son Yoon, Seoul (KR)

(73) Assignee: Morris Corporation, Inchon-shi (KR)

( * ) Notice: Subject to any disclaimer, the term of this patent is extended or adjusted under 35 U.S.C. 154(b) by 684 days.

(21) Appl. No.: 10/565,822

(22) PCT Filed: Dec. 31, 2004

(86) PCT No.: PCT/KR2004/003562

§ 371 (c)(1),
(2), (4) Date: Jan. 24, 2006

(87) PCT Pub. No.: WO2006/070962

PCT Pub. Date: Jul. 6, 2006

(65) Prior Publication Data

US 2008/0107469 A1 May 8, 2008

(51) Int. Cl.
*B43K 7/12* (2006.01)
*B43K 24/02* (2006.01)

(52) U.S. Cl. ..... 401/106; 401/105; 401/104; 401/99

(58) Field of Classification Search ..... 401/104–106, 401/99, 110, 111
See application file for complete search history.

(56) References Cited

U.S. PATENT DOCUMENTS 4,459,056 A * 7/1984 Getgey et al. ..... 401/107
5,871,296 A * 2/1999 Furukawa et al. ..... 401/106
5,915,866 A * 6/1999 Furukawa ..... 401/106
5,918,993 A * 7/1999 Koyama ..... 401/106
6,280,110 B2 * 8/2001 Lin ..... 401/106
6,336,761 B1 * 1/2002 Kudo ..... 401/106
6,382,860 B1 * 5/2002 Kim ..... 401/104
6,390,706 B1 * 5/2002 Yokouchi et al. ..... 401/104

* cited by examiner

*Primary Examiner*—Khoa D Huynh
*Assistant Examiner*—Keegan Gumbs
(74) *Attorney, Agent, or Firm*—Intellectual Property Law Group LLP; Otto O. Lee; Juneko Jackson

(57) ABSTRACT

The object of this invention is to provide a safety knock-type writing instrument. The writing instrument includes a barrel (10) with a cartridge (50), a gear unit (30), and a knock unit (60). The gear unit (30) is positioned on an exterior of the barrel (10) and rotatably seated on a clip (20). The knock unit (60) is provided in the barrel (10), and includes first and second protrusions (61, 62) to engage with the gear unit (30), thus operating the gear unit. In this writing instrument, when the first protrusion (61) of the knock unit disengages from the gear unit (30), the cartridge is retracted into the barrel. Thus, although a user puts the writing instrument, with the cartridge extended, in a pocket without first retracting the cartridge, the cartridge is automatically retracted into the barrel, thus preventing his/her clothing from being stained by the cartridge.

4 Claims, 27 Drawing Sheets

SAFETY KNOCK-TYPE WRITING INSTRUMENT

TECHNICAL FIELD

The present invention relates, in general, to writing instruments and, more particularly, to a safety knock-type writing instrument configured to automatically retract a cartridge when a user puts the writing instrument, with the cartridge extended, into his/her pocket.

BACKGROUND ART

Generally, a writing instrument includes a cartridge, a spring, a barrel, and a cartridge control unit. Further, a clip is provided at a predetermined position on the writing instrument so that a user may put the writing instrument in his/her pocket and easily carry the writing instrument.

When the user desires to use the writing instrument, the cartridge control unit is manipulated to extend the cartridge out of the barrel. On the other hand, when the writing instrument is not in use, the cartridge control unit is manipulated to retract the cartridge into the barrel and thereby store the writing instrument in his/her pocket. The writing instrument including the cartridge control unit is manipulated to extend or retract the cartridge out of or into the barrel, using a button, a push part, etc.

A knock and a gear have been widely used as the cartridge control unit. A knock-type writing instrument is constructed so that the knock and the gear are provided along a central axis in the barrel. Such a construction requires additional space for installing the knock and the gear in the barrel, thus increasing the length and width of the barrel.

However, in order to use the conventional writing instrument, the cartridge must be extended using the cartridge control unit that is separately provided. After using the writing instrument, the cartridge must be retracted using the cartridge control unit, thus causing inconvenience to a user.

The conventional writing instrument is problematic in that a user's clothing may be stained by ink dispensed from the cartridge when the writing instrument is put, with the cartridge extended, in his/her pocket.

In the writing instrument including a cap as well as the cartridge control unit, the cap must be open to use the writing instrument, and closed after using the writing instrument.

The writing instrument with the cap is problematic in that the cap must be removed and replaced whenever a user uses the writing instrument, so that the cap is likely to be lost.

Further, the conventional cartridge control unit is disadvantageous in that loud tapping sound may be generated about four times due to the shape of the gear and the elastic force of the spring, when protrusions provided on an inner circumferential surface of the barrel come into contact with the gear rotating about the central axis of the barrel. Thus, a product of high quality is not offered to consumers.

SUMMARY OF THE INVENTION

Technical Problem

Figure 1:
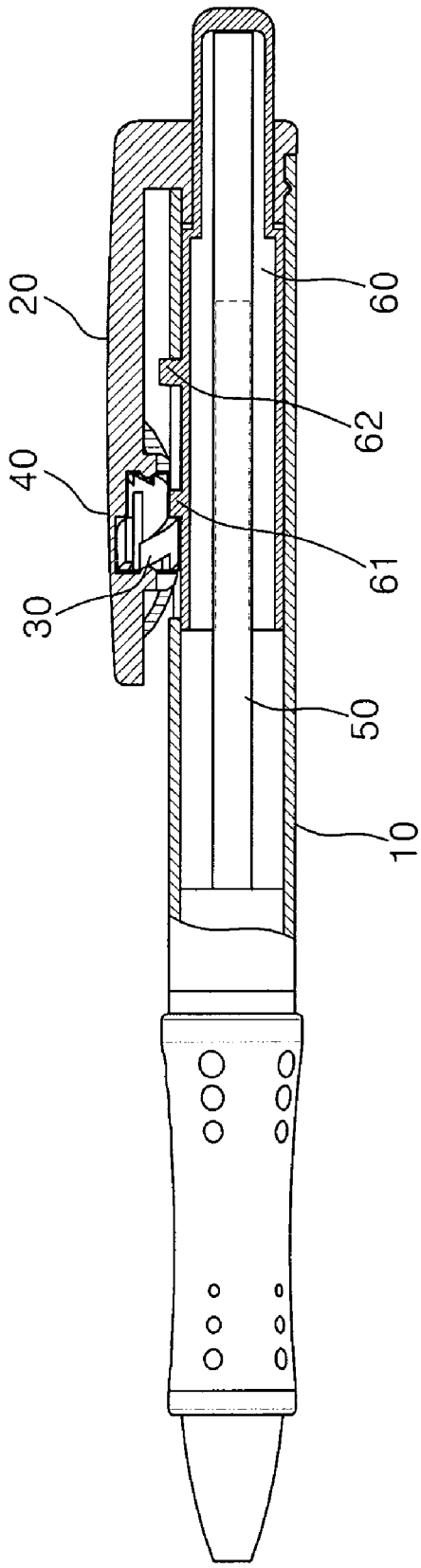
FIG. 1 is a sectional view of a safety knock-type writing instrument, according to the first embodiment of the present invention.

Accordingly, the present invention has been made keeping in mind the above problems occurring in the prior art, and an object of the present invention is to provide a safety knock-type writing instrument, which has a gear unit or a half gear unit at a predetermined position on a clip to automatically retract a cartridge when the writing instrument is put, with the cartridge extended, in a user's pocket, thus ensuring smooth operation, and preventing his/her clothing from being stained, therefore enhancing operability and convenience.

Another object of the present invention is to provide a safety knock-type writing instrument, which is constructed so that a cartridge control unit is provided in a clip outside a barrel, thus allowing a cartridge in the barrel to be lengthened, and reducing thickness of the writing instrument, and reducing thickness of the clip without affecting durability of the clip.

A further object of the present invention is to provide a safety knock-type writing instrument of high quality, which is constructed so that friction between a half gear unit of a cartridge control unit and first and second protrusions of a knock unit is small, thus reducing a tapping sound, and having little friction noise generated by the small half gear unit, even if the tapping sound is generated.

Technical Solution

In order to accomplish the above objects, the present invention provides a safety knock-type writing instrument, including a barrel having a cartridge therein; a gear unit provided on an exterior of the barrel and rotatably seated in a clip; and a knock unit positioned in the barrel, and including first and second protrusions to engage with the gear unit, wherein the cartridge is retracted into the barrel when the first protrusion of the knock unit disengages from the gear unit.

Further, in order to accomplish the above objects, the present invention provides a safety knock-type writing instrument, including a barrel having a cartridge therein; a half gear unit provided on an exterior of the barrel and rotatably seated in a clip; and a knock unit positioned in the barrel, and including first and second protrusions to engage with the half gear unit, wherein the cartridge is retracted into the barrel when the first protrusion of the knock unit disengages from the half gear unit, and the half gear unit rotates in a rotating direction and an opposite rotational direction, in response to reciprocating motion of the knock unit in a pushing direction and a releasing direction.

Further, according to the present invention, the clip includes a gear seat to rotatably seat the gear unit therein.

The gear unit includes a guide groove to axially guide the first protrusion, the guide groove having predetermined depth and length to disengage from the first protrusion when the gear unit rotates; a rotation guide part to be spirally guided by the first protrusion; a first protrusion seat to seat the first protrusion therein; and a second protrusion seat to seat the second protrusion thereon and to be spirally guided by the second protrusion.

Further, the barrel is formed so that a barrel body is integrated with a tip holder into a single structure, and includes linear guide slits having a wide opening and a narrow opening, respectively, the linear guide slits having a predetermined length and being opened at a predetermined end so that the first and second protrusions axially slide along the linear guide slits while being projected out of the linear guide slits.

Further, according to the present invention, the barrel is coupled to a ring-shaped part of the clip by engagement of a first threaded part of the barrel with a second threaded part of the clip.

The barrel has a first tapered contact surface at a position around the first threaded part, and the ring-shaped part of the clip has a second tapered contact surface to be in frictional contact with the first tapered contact surface, the first and second tapered contact surfaces providing a relatively large contact area compared to a flat surface contact manner, thus increasing a coupling force when the first threaded part of the barrel having the guide slits engages with the second threaded part of the clip.

Further, the half gear unit has a shape of an eccentric gear which rotates about a central axis thereof, and includes a first rotation guide part providing a spirally inclined slide surface so that the first protrusion of the knock unit slides along the first rotation guide part to rotate the half gear unit within a predetermined angular range; a first inclined groove part provided at a lower end of an inclined surface of the first rotation guide part to form a linearly inclined slide surface and a flat surface in a direction of an axis of rotating shafts, the first inclined groove part serving as a locking step using a height difference; a first protrusion seat provided at an end of the flat surface of the first inclined groove part to have a height different from the first inclined groove part, the first protrusion seat having a spirally inclined slide surface and a sharp corner, thus seating and stopping the first protrusion when the cartridge is extended; a second rotation guide part provided above the sharp corner of the first protrusion seat, and having a toothed shape with a spirally inclined slide surface; a second inclined groove part which is the equal to the first inclined groove part, but has a linear inclined slide surface and a flat surface in an opposite direction to the first inclined groove part; a third rotation guide part having a slide surface so that the second protrusion of the knock unit slides along the third rotation guide part; a second protrusion seat to function as a stopper of the second protrusion; and first and second sidewalls provided outside the first and second inclined groove parts to be perpendicular to the first and second inclined groove parts, the first and second sidewalls guiding and restraining the rotation of the first protrusion within the predetermined angular range.

ADVANTAGEOUS EFFECTS

A safety knock-type writing instrument according to the present invention is a mechanism constructed so that a gear unit or a half gear unit is provided at a predetermined position on a clip. In this case, the gear unit rotates in a predetermined direction, in response to linear reciprocating motion of a knock unit, or the half gear unit rotates in opposite directions, in response to the linear reciprocating motion of the knock unit, thus allowing a tip of a cartridge coupled to the knock unit to be smoothly retracted or extended without generating loud noise.

According to the present invention, although a user puts a writing instrument, with a cartridge extended, in a pocket without first retracting the cartridge, a gear unit or a half gear unit is provided at a predetermined position on a clip, thus allowing the cartridge to be smoothly retracted, and thereby preventing his/her clothing from being stained.

In the writing instrument of the present invention, a half gear unit occupying relatively little space is mounted to a clip, thus keeping construction of the clip simple without affecting durability thereof, therefore having competitiveness as a product, promoting sales of the product, and satisfying consumers' demand for unique products.

Further, a safe knock-type writing instrument of this invention provides a barrel which is formed so that a barrel body is integrated with a tip holder, thus reducing the number of parts.

In a writing instrument of the present invention, a half gear unit is mounted to a clip to be mounted outside an interior of a barrel, thus allowing internal space in the barrel to be more efficiently used, and allowing thickness of the writing instrument to be adjusted as desired.

Further, a writing instrument of this invention allows a user to confirm operation of the writing instrument with his/her eyes, thus providing convenience to the user, when a clip equipped with a half gear unit is made of a transparent material.

DETAILED DESCRIPTION OF SPECIFIC EMBODIMENTS

Reference should now be made to FIGS. 1 through 8F showing the first embodiment and FIGS. 9A through 15E showing the second embodiment, in which similar reference numerals are used throughout the different drawings to designate the same or similar components.

Referring to FIG. 1, a safety knock-type writing instrument according to the first embodiment of the present invention includes a barrel 10, a clip 20 for holding the writing instrument in a user's pocket or the like, and a gear seat 40 provided in the clip 20. In this case, a gear unit 30 is rotatably seated in the gear seat 40.

A cartridge 50 is provided in the barrel 10. Further, a knock unit 60 is provided in the barrel 10 at a position corresponding to an upper portion of the cartridge 50, and includes two protrusions 61 and 62.

A linear guide slit of a predetermined length is formed along the barrel 10 to be positioned between the gear unit 30 and the knock unit 60, so that the protrusions 61 and 62 axially reciprocate along the linear guide slit while projecting out of the linear guide slit.

Two protrusions 61 and 62, that is, the first and second protrusions 61 and 62, project out of the linear guide slit to engage with the gear unit 30, thus extending or retracting the cartridge of the writing instrument. The first and second protrusions 61 and 62 are integrally provided on an outer circumferential surface of the knock unit 60 to be aligned in a row. For example, it is preferable that the first protrusion 61 have a parallelogram cross-section, and the second protrusion 62 have a wedge-type rectangular cross-section which is inclined at one side.

An upper portion of the knock unit 60 is a push part having a button shape, which is used to extend or retract the cartridge 50.

The push part of the knock unit 60 passes through a center of a ring-shaped part of the clip 20 to be exposed to the outside, so that a user applies finger pressure to the push part, thus rectilinearly reciprocating the knock unit 60 and the cartridge 50. Further, a spring (not shown) with predetermined elastic force is mounted to a lower portion of the cartridge 50 in the barrel 10.

The spring generates a force for rotating the gear unit 30, in response to the linear reciprocating motion of the knock unit 60.

Since the writing instrument is constructed so that the gear unit 30 is not provided in the barrel 10, it is possible to use a cartridge 50 having high capacity, which has a long length corresponding to the length of the barrel 10. Further, because the cylindrical gear unit 30 is not provided in the barrel 10, it is possible to reduce the thickness of the barrel 10. Meanwhile, when the clip 20 is made of a transparent material, a user can confirm the operation of the gear unit 30 in the clip 20.

According to the present invention, the first and second protrusions 61 and 62 of the knock unit 60 have shape corresponding to that of the gear unit 30 to be operated while engaging with the gear unit 30, so that a loud tapping sound is not generated, but only a little friction noise is generated, thus achieving a writing instrument making little noise.

As shown in FIG. 1, the safety knock-type writing instrument of this invention is constructed so that the gear unit 30 is not positioned in the barrel 10, but positioned in the gear seat 40 which is additionally provided in the clip 20. When the writing instrument is not in use, the gear unit 30 engages with the first protrusion 61.

When the gear unit 30 engages with the first protrusion 61, the cartridge is retracted into the barrel 10. In such a state, when a user pushes the push part provided at the upper end of the knock unit 60 to extend the cartridge out of the barrel 10, the first protrusion 61 disengages from the gear unit 30, and the gear unit 30 moves while rotating.

Thus, the cartridge is extended out of the barrel. After using the writing instrument, the user puts the clip 20 in his/her pocket, without pushing the push part to retract the cartridge 50 into the barrel 10. In this case, the first protrusion 61 disengages from the gear unit 30 while the cartridge 50 is automatically retracted, thus preventing a user's clothing from being stained by the extended cartridge 50.

Figure 2:
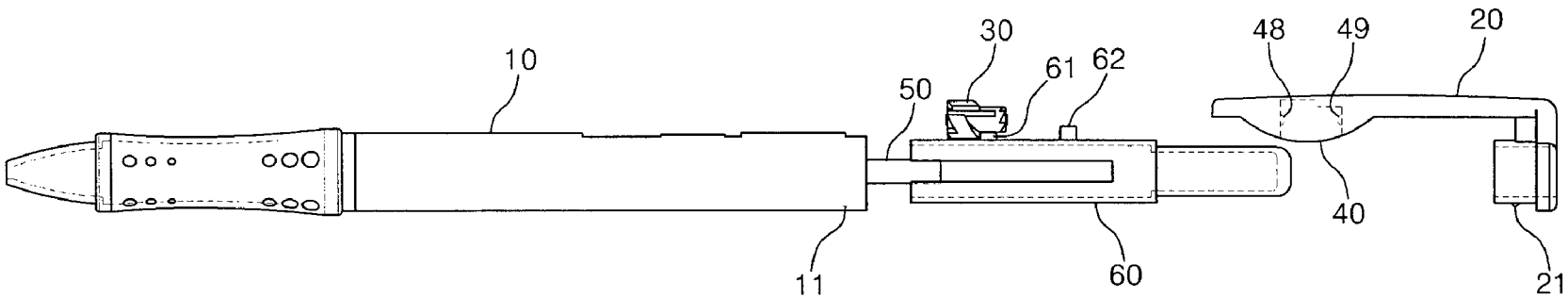
FIG. 2 is an exploded view of the writing instrument of FIG. 1.

FIG. 2 shows the barrel 10, the cartridge 50, and the knock unit 60 provided at the upper portion of the cartridge 50. The gear unit 30 is disposed to come into contact with either the first protrusion 61 or the second protrusion 62.

Figure 4A:
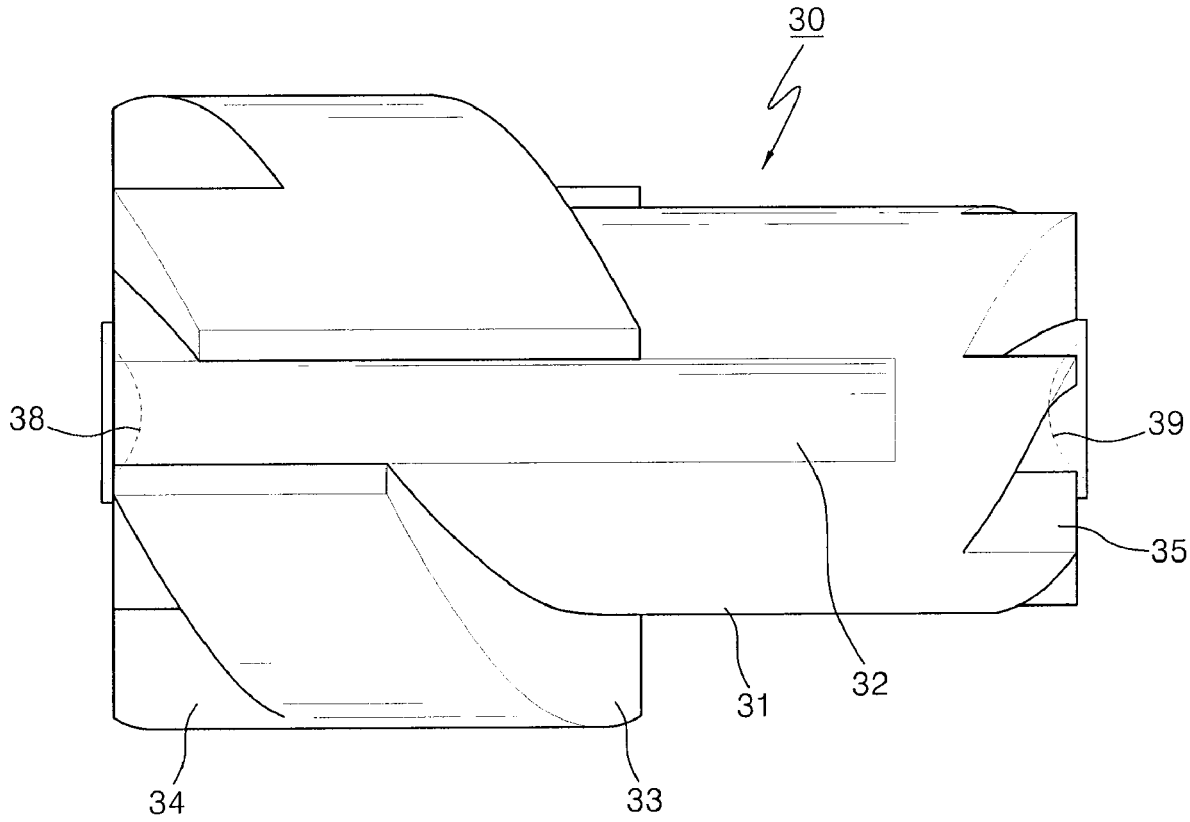
FIG. 4A is a front view to illustrate a gear unit included in the writing instrument of FIG. 1.
Figure 4B:
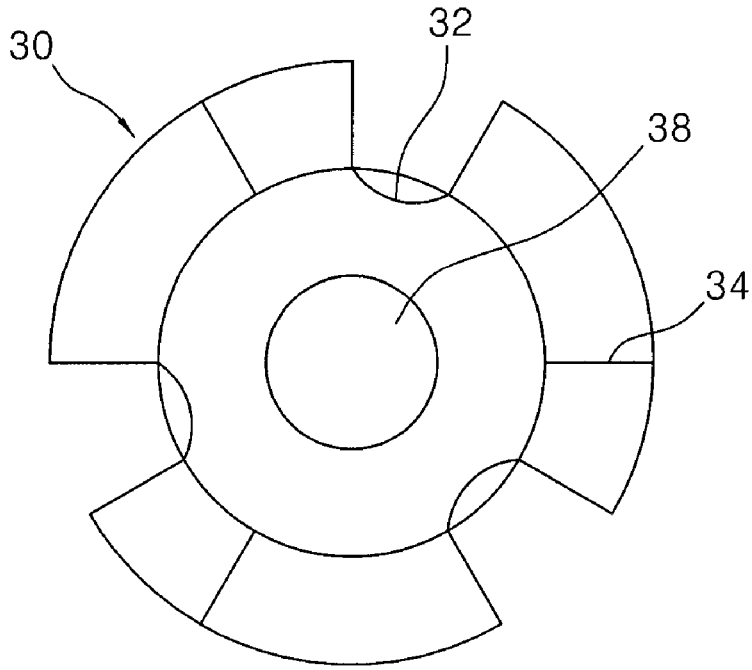
FIG. 4B is a left side view to illustrate the gear unit included in the writing instrument of FIG. 1.
Figure 4C:
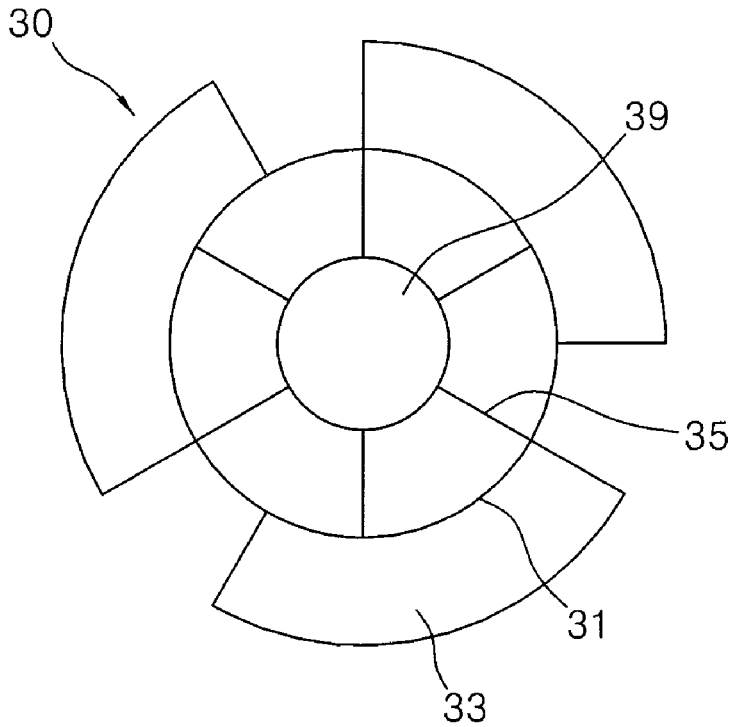
FIG. 4C is a right side view to illustrate the gear unit included in the writing instrument of FIG. 1.

On both sides of an inner surface of the gear seat 40 are provided projecting parts 48 and 49 having a hemispherical shape to be coupled to the gear unit 30. Referring to FIGS. 4A, 4B, and 4C, recessed parts 38 and 39 are provided on both sides of the gear unit 30 along a central axis thereof to be coupled to the gear seat 40. The projecting parts 48 and 49 are coupled to the corresponding recessed parts 38 and 39, so that the coupling functions as a rotating shaft to rotate the gear unit 30 about the projecting parts 48 and 49.

A locking hole 11 is provided at a position around a top opening of the barrel 10, and a locking projection 21 is provided on an outer circumferential surface of an insert part of the clip 20.

When the insert part of the clip 20 is fitted into the top opening of the barrel 10, the locking projection 21 is inserted into the locking hole 11, thus allowing the writing instrument to be rapidly disassembled or assembled as necessary.

Figure 3:
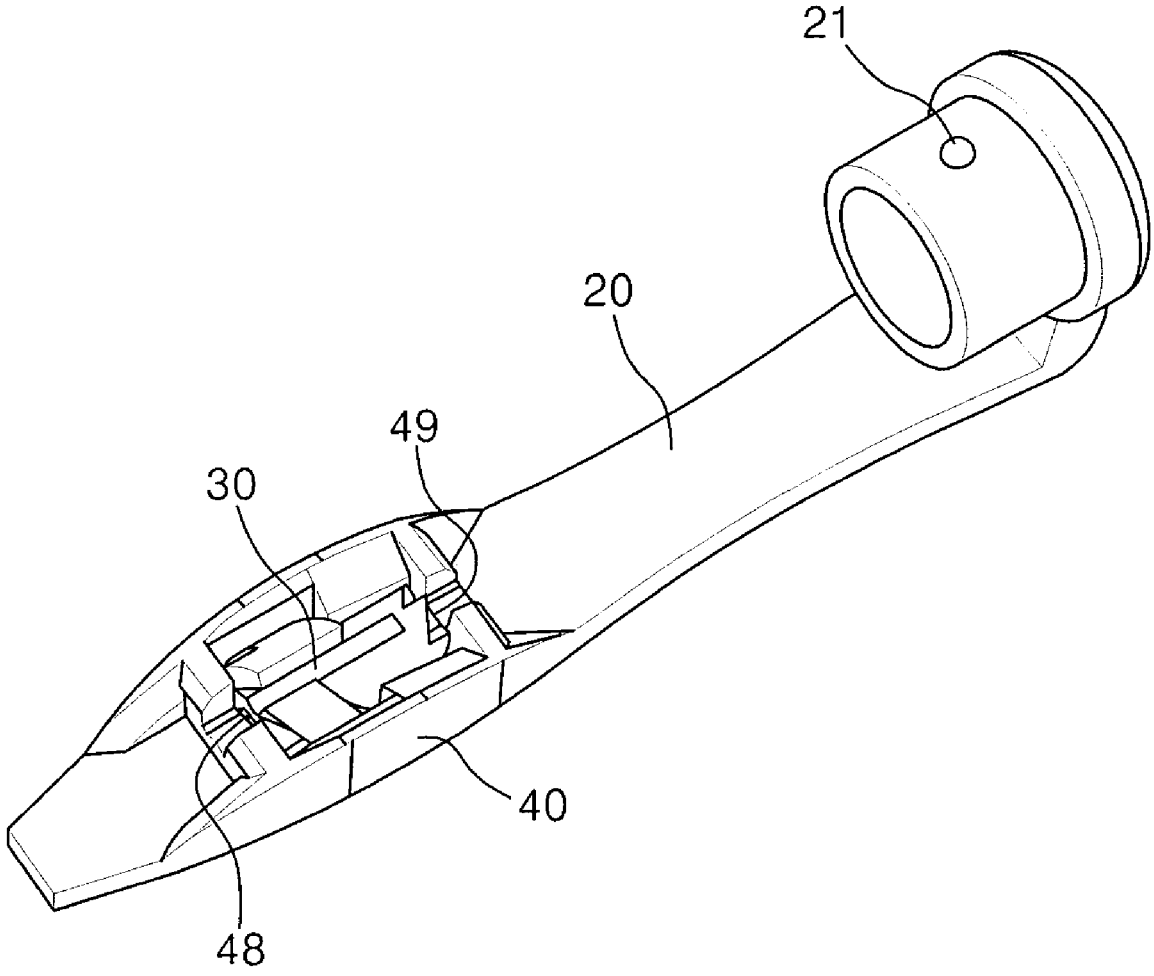
FIG. 3 is a perspective view to illustrate a clip included in the writing instrument of FIG. 1.

FIG. 3 is a view to illustrate the clip 20 of the safety knock-type writing instrument according to the present invention.

Referring to FIG. 3, the gear seat 40 is provided at a predetermined position on the clip 20, and the gear unit 30 is seated in the gear seat 40. When the cartridge 50 begins to extend or retract, the gear unit 30 is operated while rotating in the gear seat 40.

FIGS. 4A, 4B, and 4C are enlarged views to show the gear unit 30 seated in the gear seat 40.

Referring to FIGS. 2, 4A, 4B, and 4C, the gear unit 30 has a gear body 31, with the recessed parts 38 and 39 provided on both sides of the gear body 31 along the central axis thereof to serve as the rotating shaft.

Further, a large-diameter part and a small-diameter part are integrally provided on the gear body 31. The large-diameter part has a plurality of first protrusion seats 34, and the small-diameter part has a plurality of second protrusion seats 35.

In order to rotate the gear unit 30 within a predetermined angular range, the first and second protrusion seats 34 and 35 have a plurality of inclined slide surfaces in a form similar to a toothed gear, to correspond to the first and second protrusions 61 and 62.

The first protrusion seats 34 have shape to allow the first projection 61 of the knock unit 60 to be slidably seated in the first protrusion seats 34. Further, rotation guide parts 33 are provided opposite the first protrusion seats 34. In this case, each of the first protrusion seats 34 corresponds to each of the rotation guide parts 33.

The gear unit 30 has a guide groove 32 to engage with the first protrusion 61. In this case, it is preferable that the guide groove 32 have a predetermined depth and length and a semicircular cross-section, so that the guide groove 32 disengages from the first protrusion 61 during the rotation of the gear unit 30.

The second protrusion seats 35 spirally guide the second protrusion 62 of the knock unit 60 so that the second protrusion 62 is slidably seated in the second protrusion seats 35. Thereby, the second protrusion seats 35 function to rotate the gear unit 30 within a predetermined angular range.

The operation of the gear unit and the knock unit will be described in detail with reference to FIGS. 5*a* through 8*f*.

First, the operation of extending the cartridge out of the writing instrument will be described below.

Figure 5A:
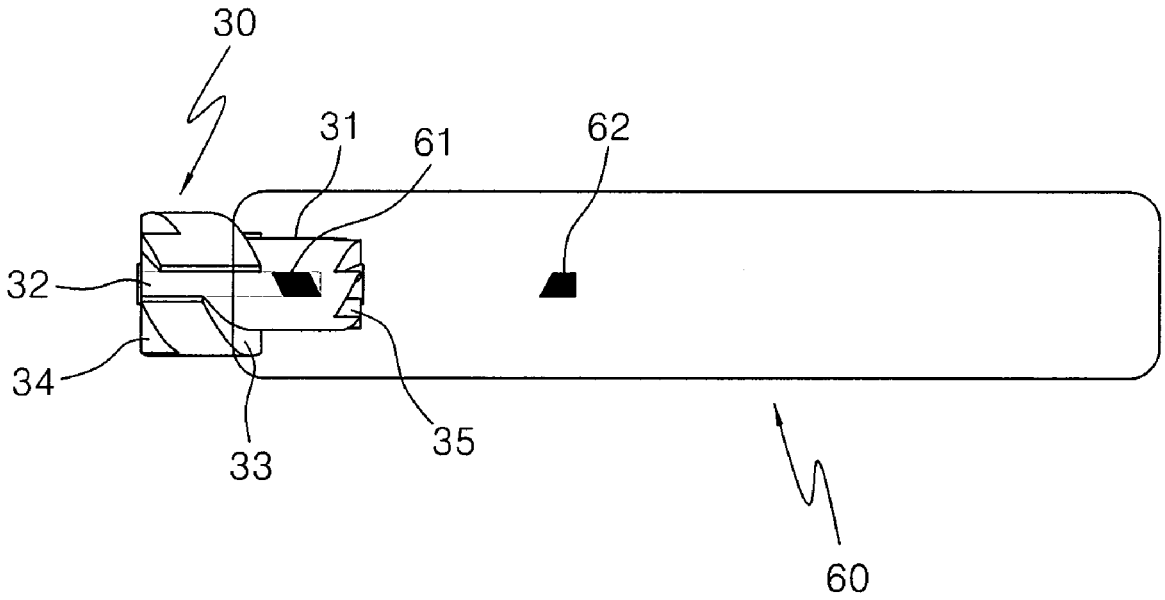
FIGS. 5A through 8F are views to illustrate operation of a knock unit of the writing instrument of FIG. 1.

FIG. 5A shows the state where the writing instrument of the present invention is normally assembled. For easy description of the present invention, the coupling of the gear unit 30 with the knock unit 60 is shown in FIG. 5A in detail.

As shown in FIGS. 4A to 4C, the gear unit 30 includes the guide groove 32 on the gear body 31. The gear unit 30 also has the rotation guide parts 33 to guide the first protrusion 61, and the first and second protrusion seats 34 and 35 to seat the corresponding first and second protrusion 61 and 62 therein.

Figure 5B:
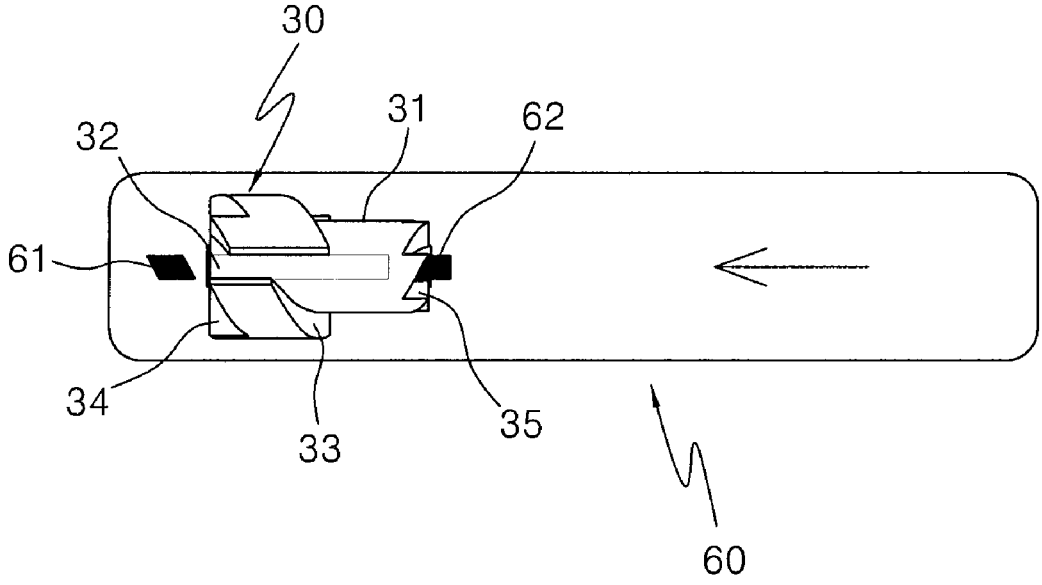

FIG. 5A show the gear unit 30 and the knock unit 60 when the cartridge 50 is retracted. That is, the first protrusion 61 engages with the guide groove 32 provided on the gear body 31. In such a state, when the knock unit 60 is pushed to extend the cartridge, as shown in FIG. 5B, the first protrusion 61 disengages from the guide groove 32 while moving downward. Further, when the knock unit 60 is pushed to the maximum, the first protrusion 61 moves further downward, and the second protrusion 62 is seated in the second protrusion seat 35. This is shown in FIG. 5C.

Figure 5C:
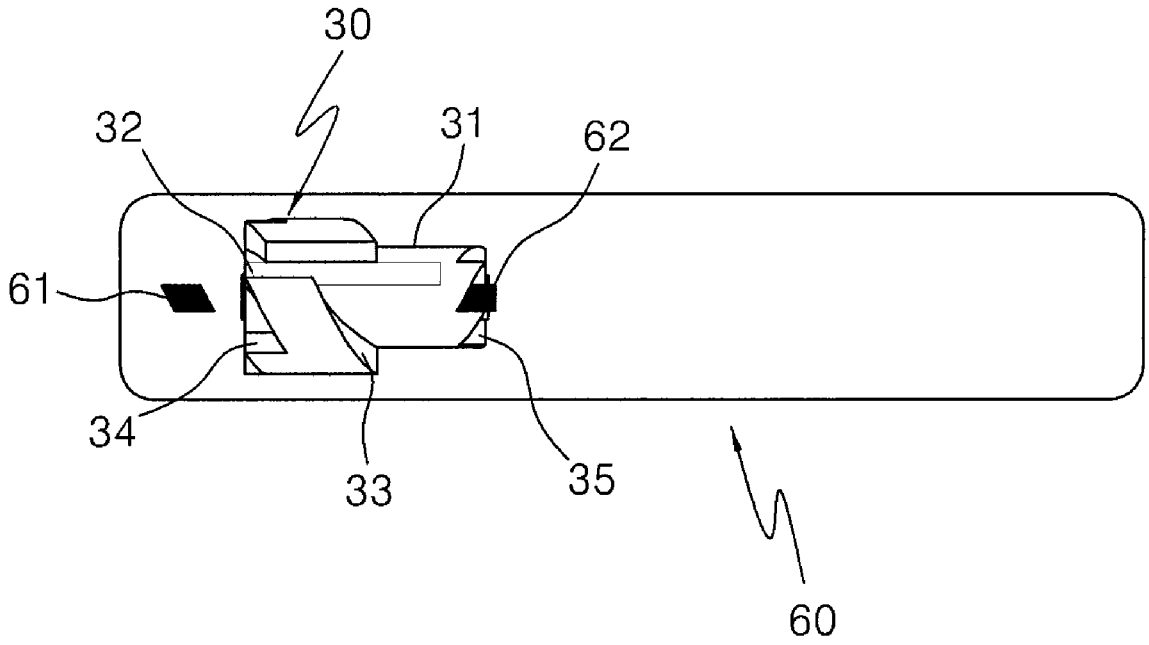
Figure 5D:
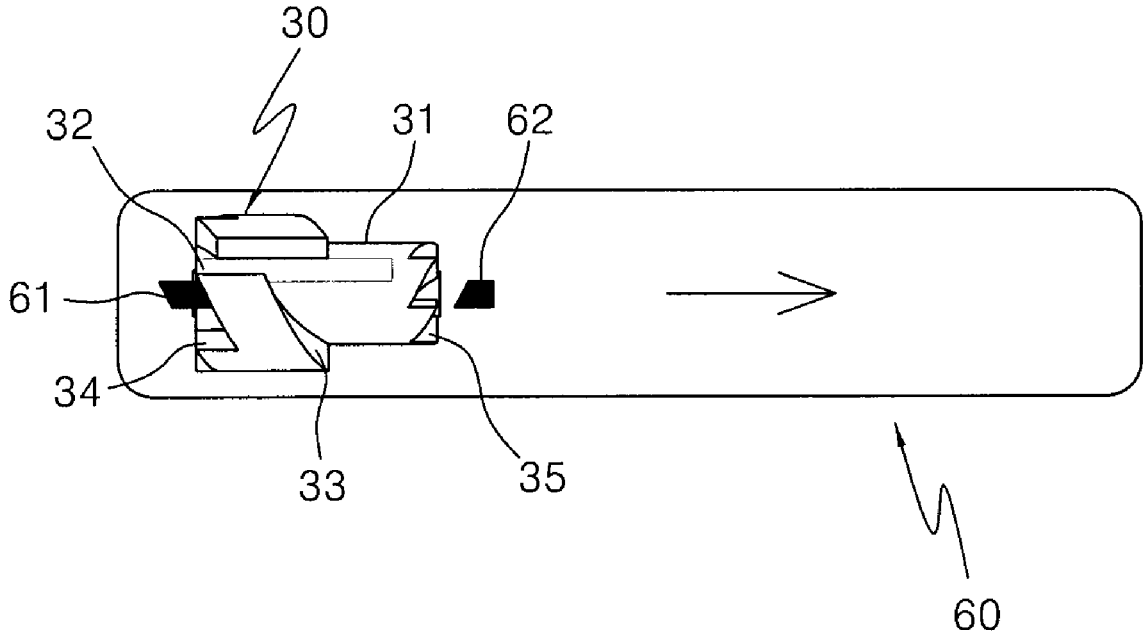

As shown in FIG. 5C, when the knock unit 60 is pushed to the maximum, the second protrusion 62 is rotatably seated in the second protrusion seat 35, so that the knock unit 60 is not pushed any more. In such a state, when a user's finger is released from the knock unit 60, as shown in FIG. 5D, the knock unit 60 moves upward due to the restoring force of the spring, and the first protrusion 61 moves to the first protrusion seat 34.

Figure 5E:
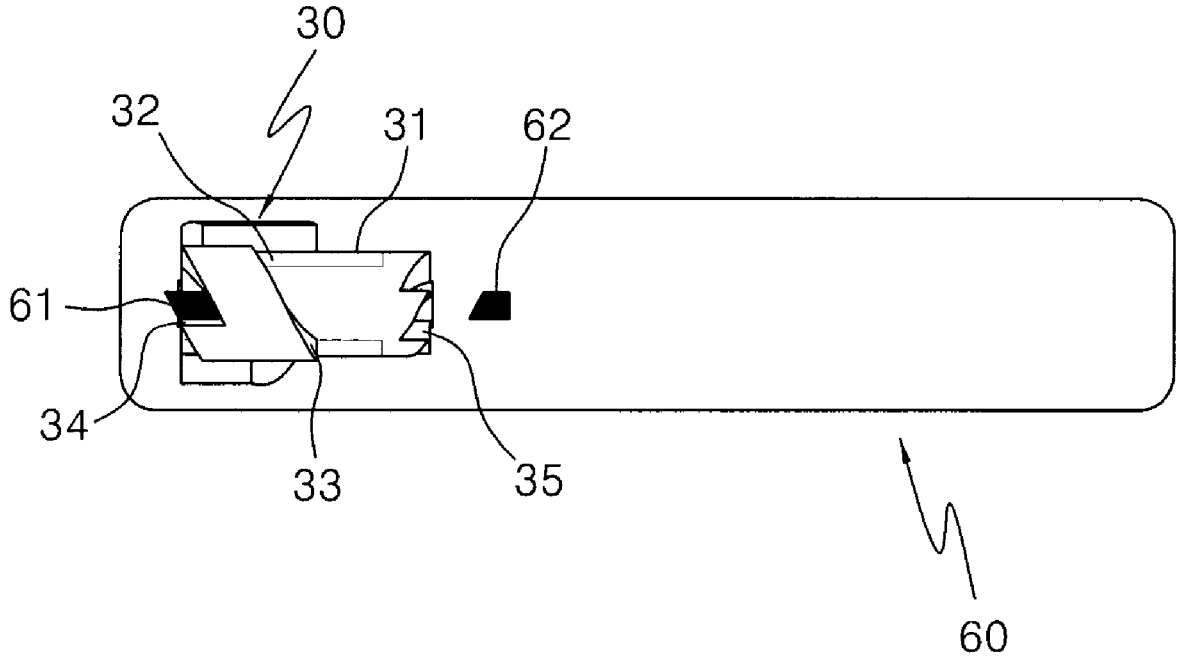

At this time, the gear unit 30 rotates while the first protrusion 61 is seated in the first protrusion seat 34. This is shown in FIG. 5E. As such, when the first protrusion 61 is seated in the first protrusion seat 34, the cartridge is extended out of the barrel.

After using the writing instrument, the process of retracting the cartridge 50 by pushing the knock unit 60 again will be described with reference to FIGS. 6A to 6E.

The process of retracting the cartridge 50 shown in FIGS. 6A to 6E is the reverse of the process of extending the cartridge shown in FIGS. 5A to 5E.

Figure 6A:
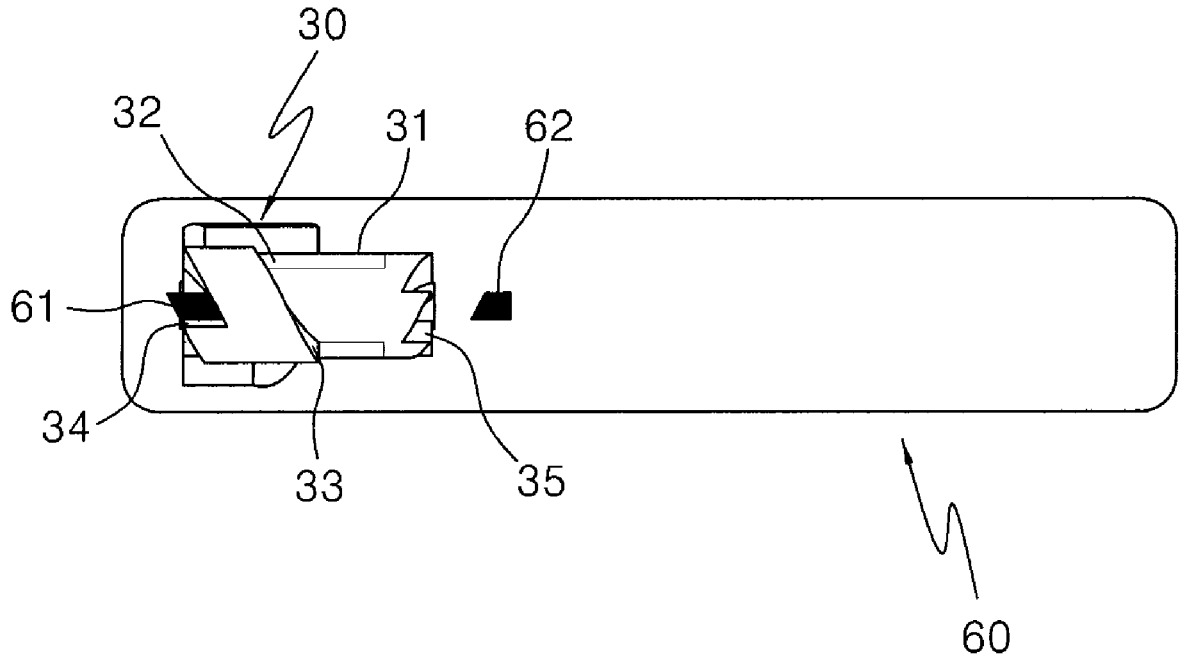
Figure 6B:
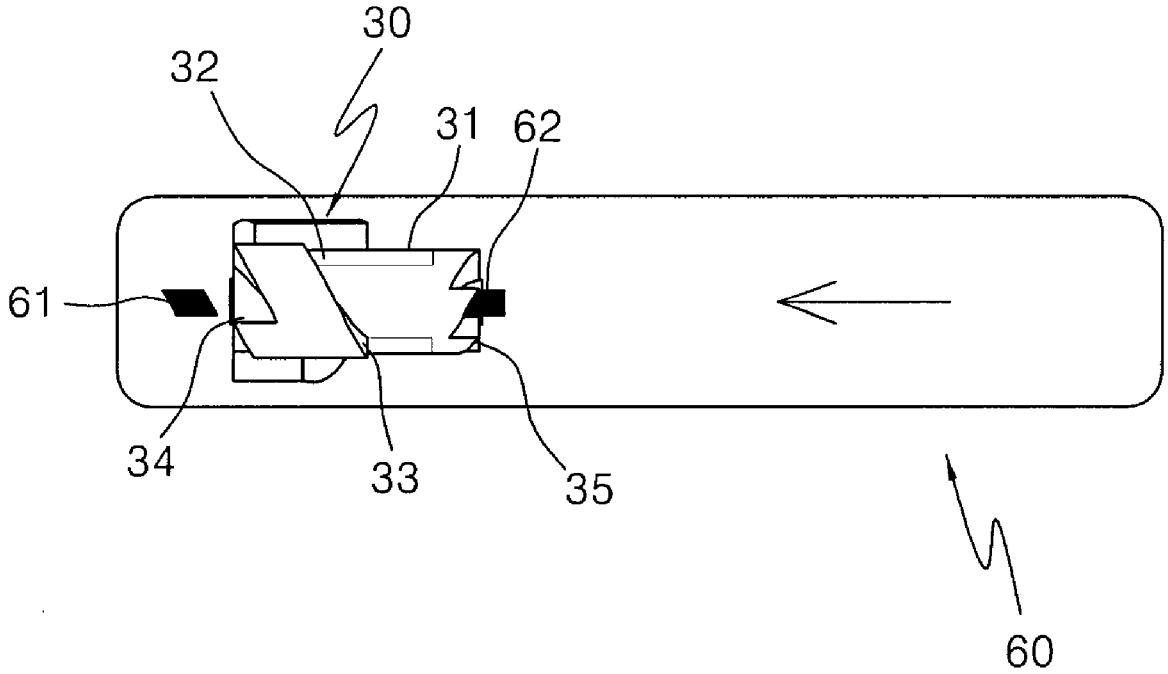

That is, as shown in FIG. 6A, when the first protrusion 61 is seated in the first protrusion seat 34, the cartridge is extended out of the barrel. In such a state, when the knock unit 50 is pushed to retract the cartridge, the first protrusion 61 is removed from the first protrusion seats 34 while moving downward. This is shown in FIG. 6B.

Figure 6C:
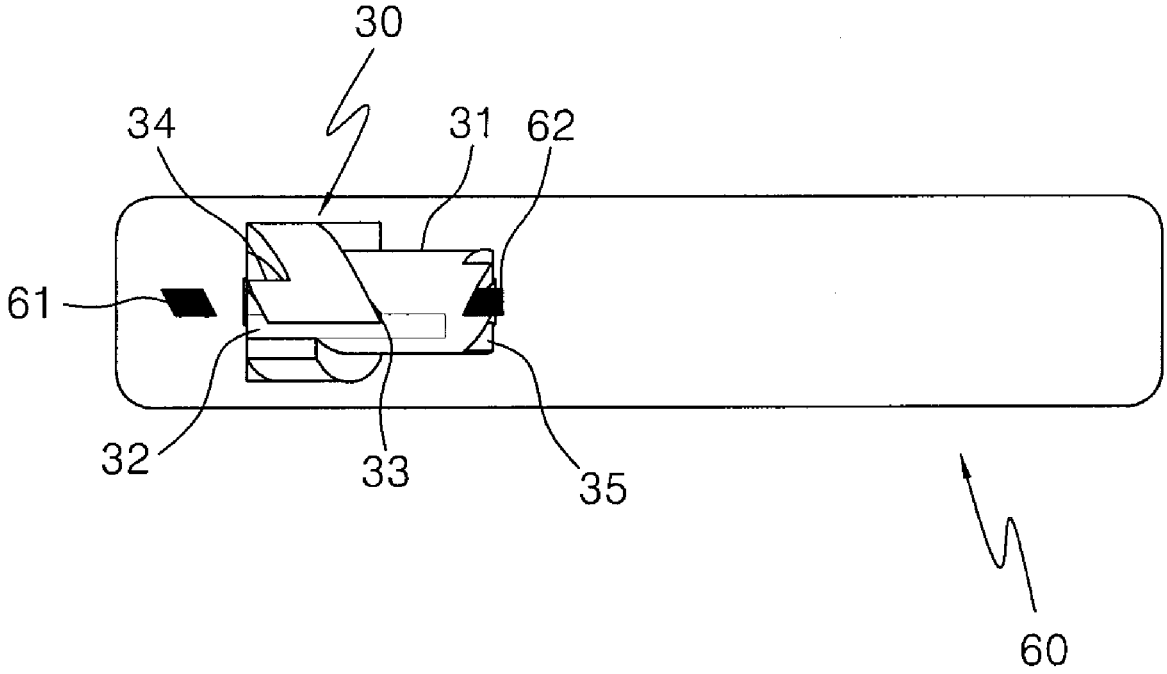
Figure 6D:
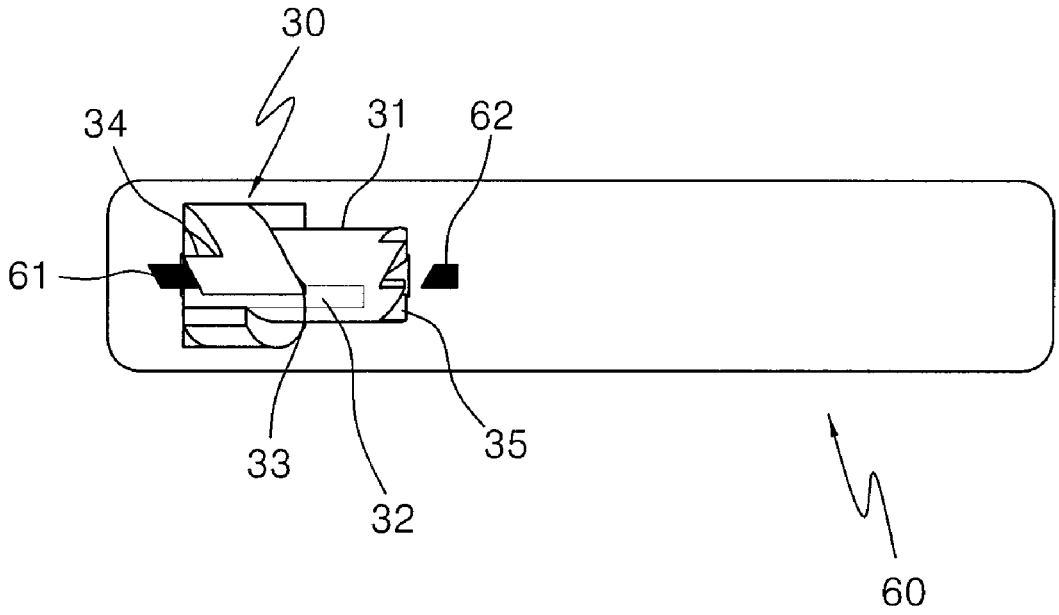
Figure 6E:
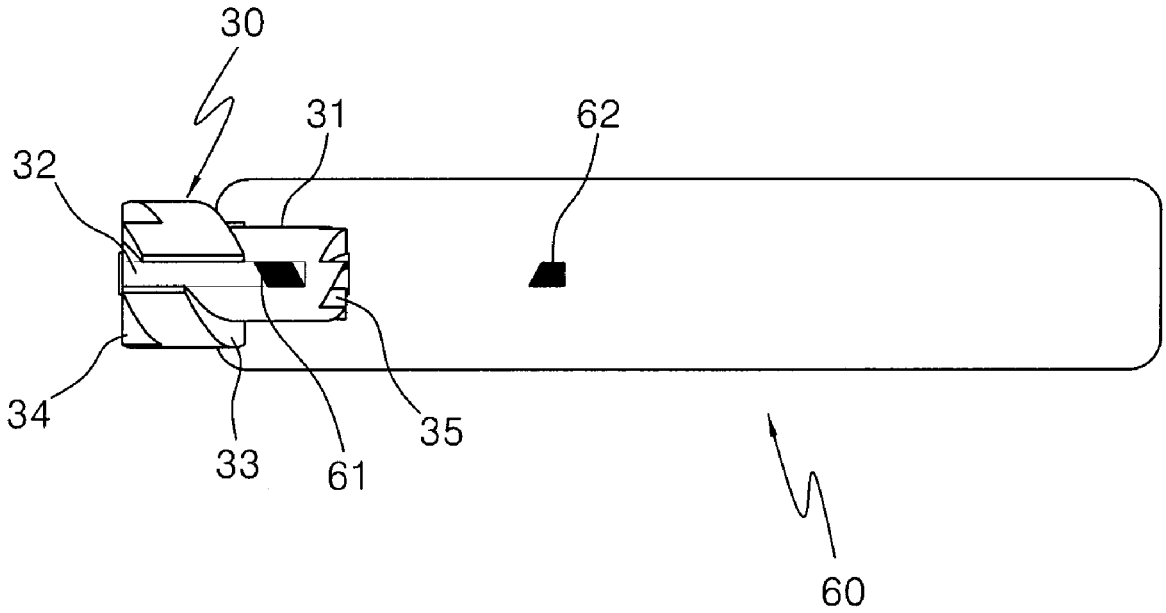

When the knock unit 60 is pushed to the maximum, as shown in FIG. 6C, the second protrusion 62 is seated in the second protrusion seat 35, so that the knock unit 60 is not pushed any more. In this state, when a user's finger is released from the knock unit 60, the first protrusion 61 moves upward by the elastic force of the spring while the gear unit 30 rotates. This is shown in FIG. 6D. As the gear unit 30 rotates, the first protrusion 61 moves upward along the guide groove 32 of the gear unit. This is shown in FIG. 6E. As such, the first protrusion 61 engages with the guide groove 32 provided on the gear body 31, so that the cartridge is retracted into the barrel.

The safety knock process will be described below with reference to FIGS. 7A and 7B. Such a process is executed to retract the cartridge 50, when the writing instrument is put, with the cartridge extended, in a user's pocket, without pushing the knock unit 60 to retract the cartridge.

Figure 7A:
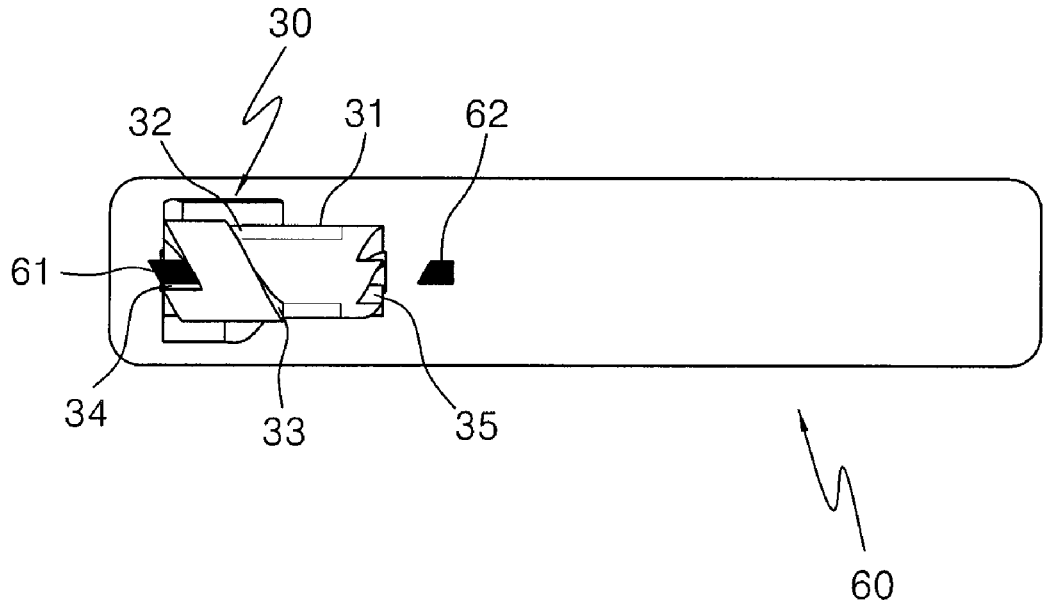

When the writing instrument is put in his/her pocket without first retracting the extended cartridge of FIG. 7A, the clip 20 moves away from the barrel 10. Thus, the first protrusion 61 of the knock unit 60 is removed from the first protrusion seat 34.

Figure 7B:
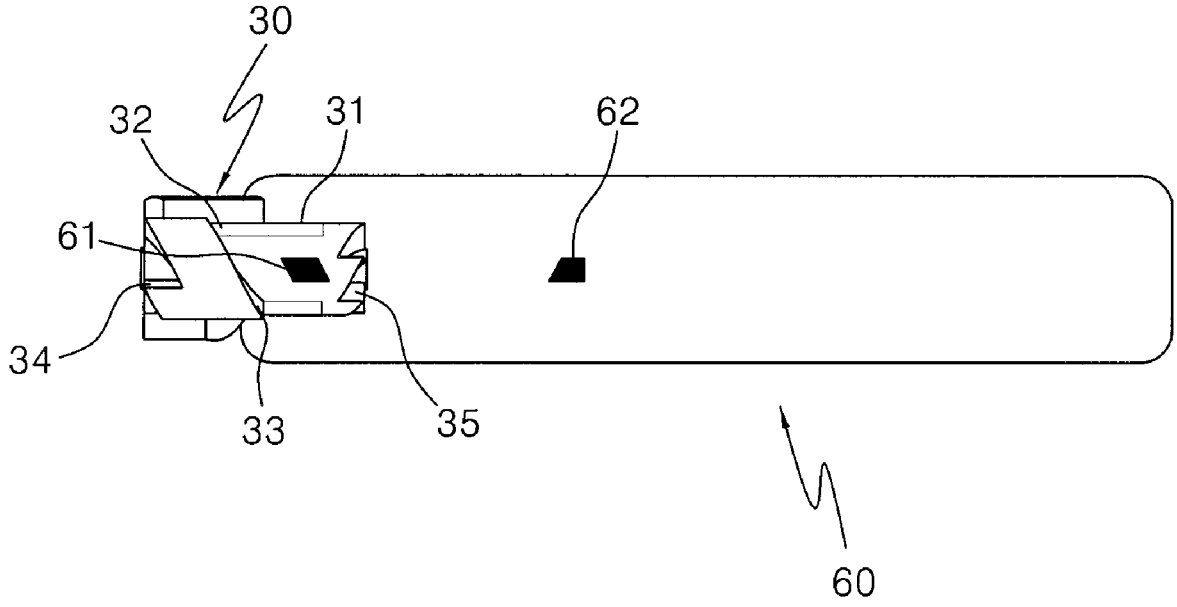

Further, as shown in FIG. 7B, the knock unit 60 moves upward by the restoring force of the spring, while the first protrusion 61 is located at a position on the gear body 31, so that the cartridge is retracted into the barrel. Thus, although the user puts the writing instrument, with the cartridge extended, in his/her pocket, without first retracting the cartridge, the safety knock process is performed to retract the cartridge into the barrel. The process of extending the retracted cartridge again will be described below with reference to FIGS. 8A to 8F.

Figure 8A:
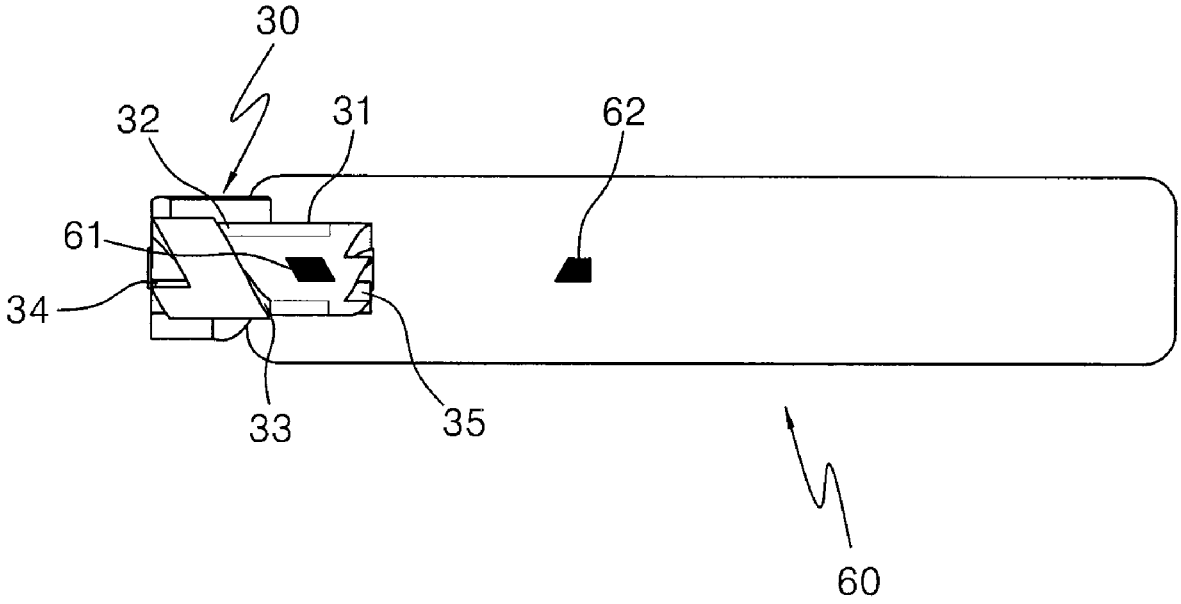
Figure 8B:
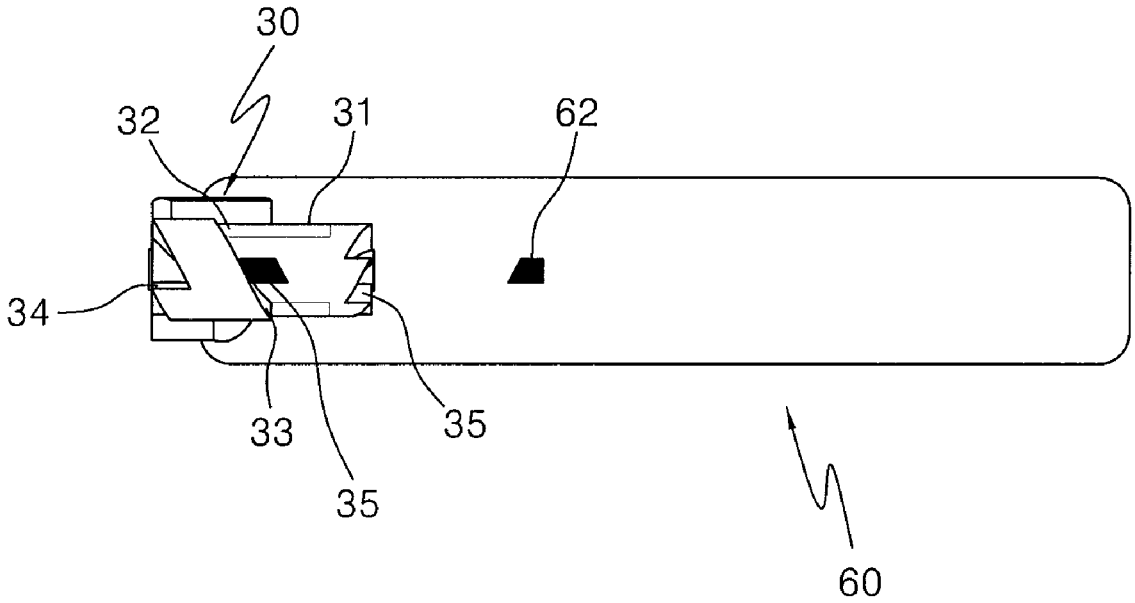

FIG. 8A shows the state where the cartridge is retracted in the safety knock mode. That is, the first protrusion 61 is located at a position on the gear body 31. In such a state, when the knock unit 60 is pushed to extend the cartridge, the gear unit 30 is rotated (see, FIG. 8B), and the first protrusion 61 located at the gear body 31 moves along the rotation guide part 33 of the gear unit 30 to be positioned under the guide groove 32. This is shown in FIG. 8C.

Figure 8C:
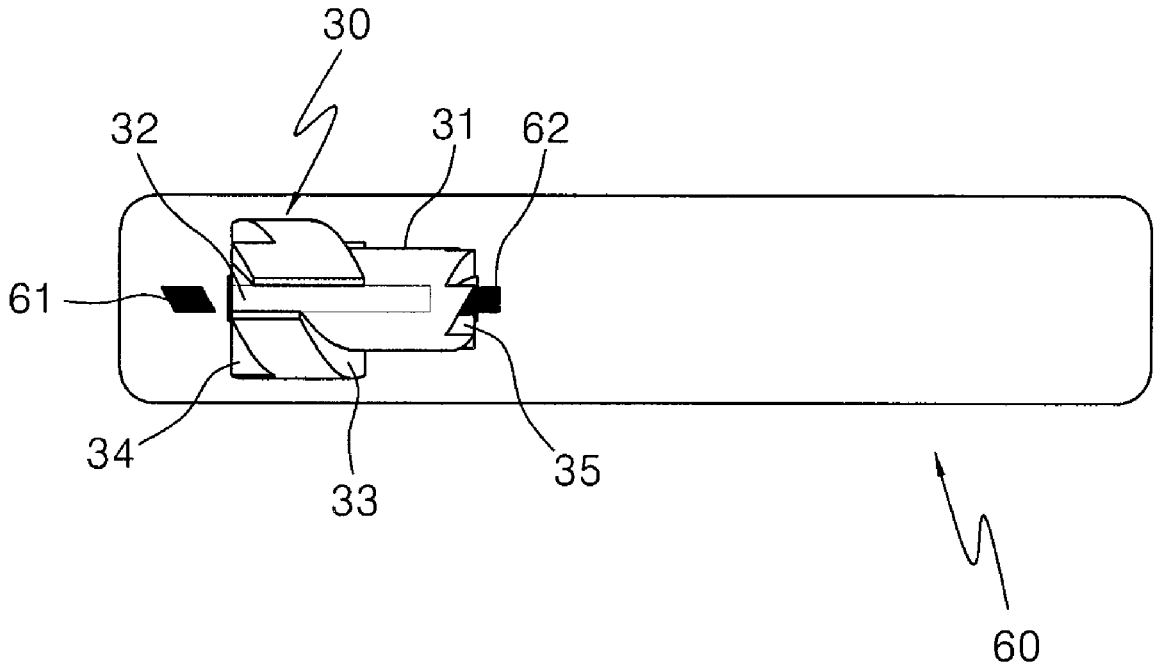

As shown in FIG. 8C, the first protrusion 61 disengages from the guide groove 32, and moves downward. When the knock unit 60 is pushed to the maximum, the first protrusion 61 moves further downward, and thereby the second protrusion 62 is seated in the second protrusion seat 35. This is shown in FIG. 8D.

Figure 8D:
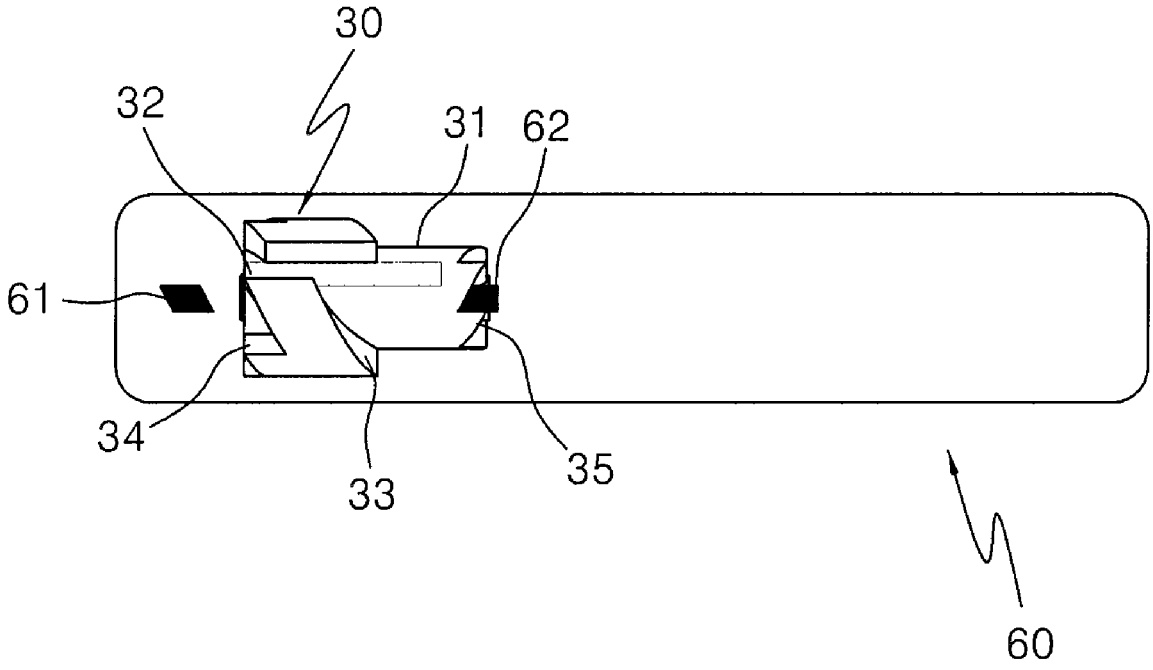
Figure 8E:
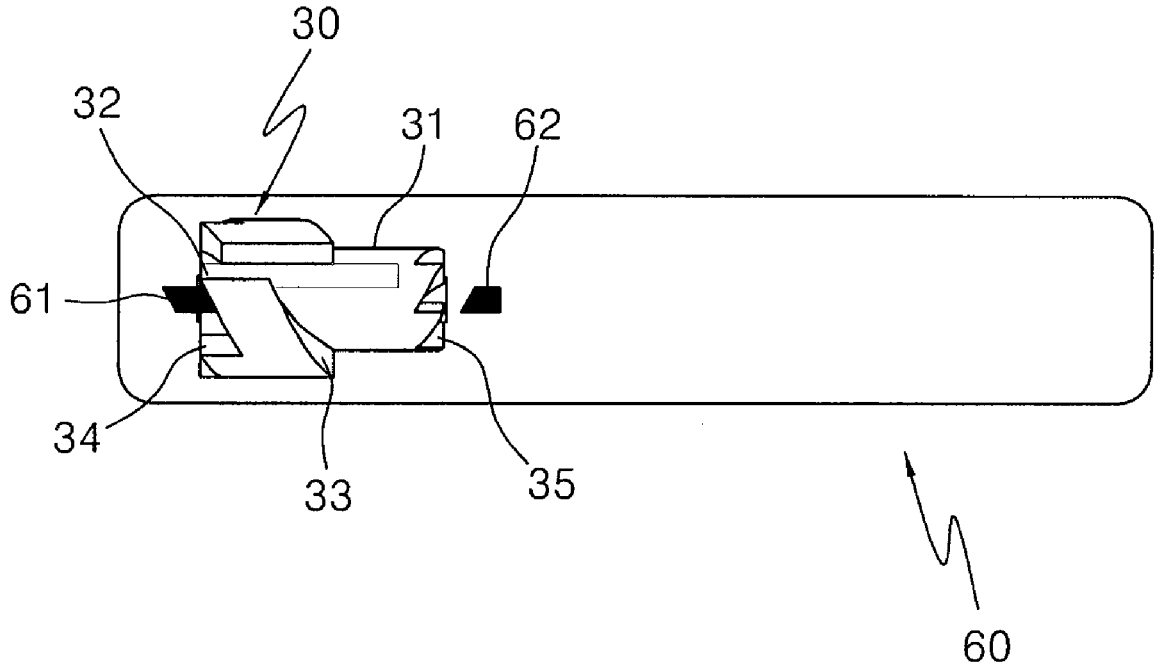
Figure 8F:
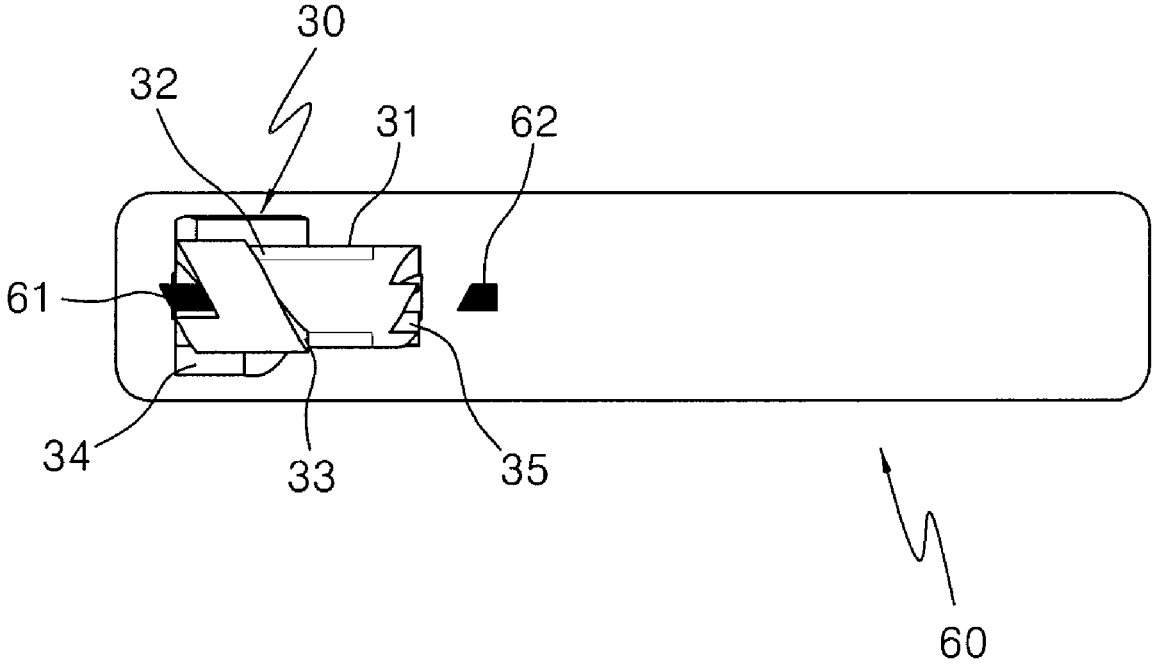

As shown in FIG. 8D, when the knock unit 60 is pushed to the maximum, the second protrusion 62 is seated in the second protrusion seat 35, so that the knock unit 60 is not pushed any more. In this state, when the user's finger is released from the knock unit 60, as shown in FIG. 8E, the knock unit 60 moves upward, and the first protrusion 61 moves to the first protrusion seat 34. At this time, the gear unit 30 continuously rotates, while the first protrusion 61 is seated in the first protrusion seat 34. This is shown in FIG. 8F. As such, when the first protrusion 61 is seated in the first protrusion seat 34, the cartridge is extended out of the barrel.

The safety knock-type writing instrument of the present invention is capable of retracting the extended cartridge smoothly and automatically, if the writing instrument, with the cartridge extended, is undesirably put in his/her pocket or collar, thus preventing his/her clothing from being stained by the extended cartridge.

A safety knock-type writing instrument according to the second embodiment of the present invention will be described hereinafter in detail.

Figure 9A:
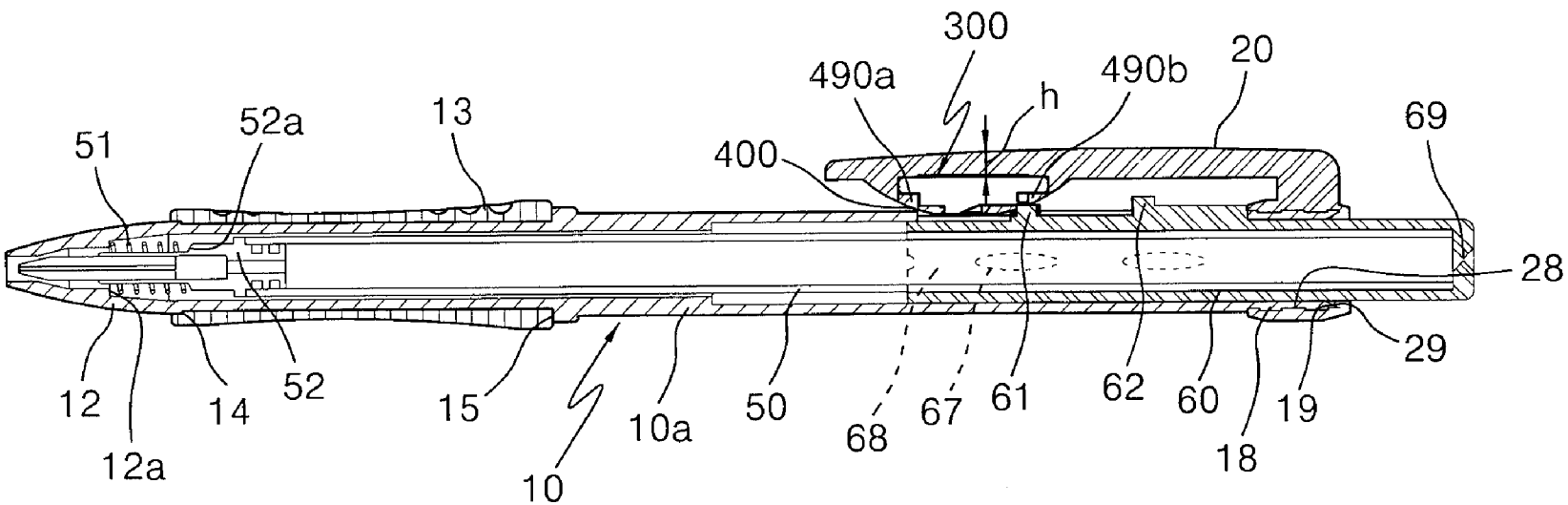
FIGS. 9A and 9B are sectional views of a safety knock-type writing instrument, according to the second embodiment of the present invention.
Figure 9B:
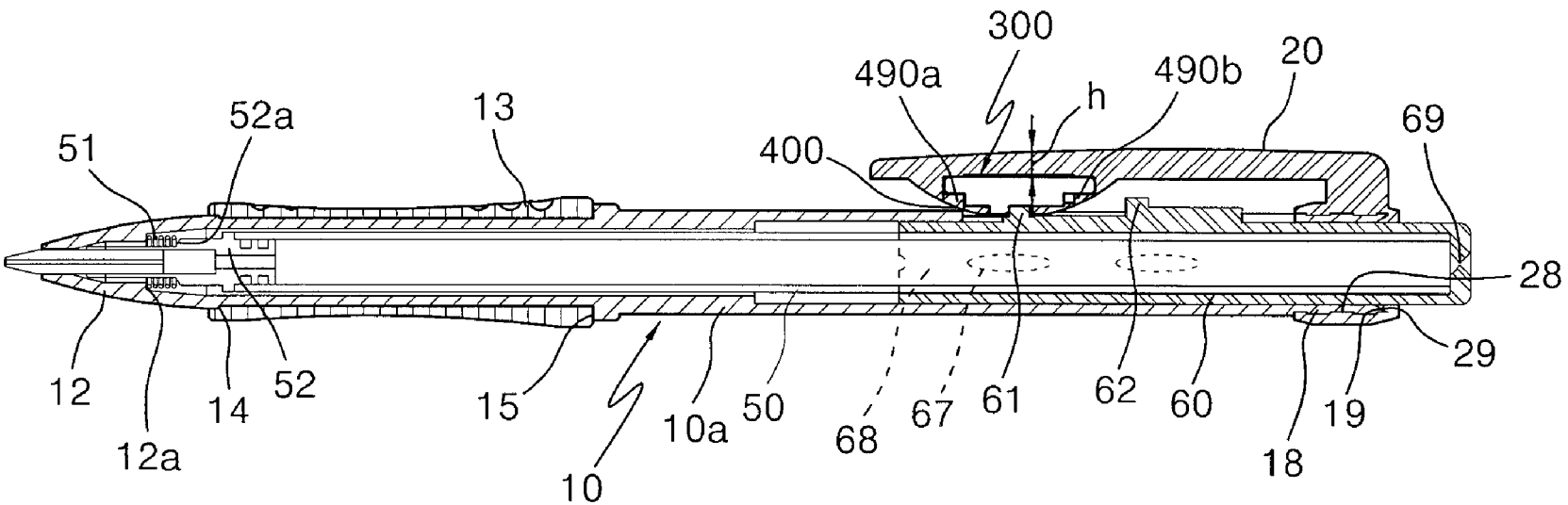

Referring to FIGS. 9A and 9B, a half gear unit 300 is rotatably seated in a gear seat 400 of the clip 20.

The gear seat 400 has a layout which allows rotating shafts of the half gear unit 300, requiring relatively smaller installation space, to be rotated within a predetermined angular range. In order to force the half gear unit 300 to be fitted into the gear seat 400, shaft fitting members 490*a* and 490*b* are provided at both sides on an inner surface of the gear seat 400.

The gear seat 400 requires relatively smaller installation space, compared to space for installing the cylindrical gear unit according to the first embodiment, thus allowing the clip 20 to have relatively thin thickness h around the gear seat 400 and have a simple construction, and allowing the thickness of a support part of the clip 20 to be adjusted to provide sufficient durability.

A barrel 10 is fabricated by integrating a barrel body 10*a* with a tip holder 12, through an injection molding process, thus reducing the number of parts. An annular step 12*a* is provided at a predetermined position in the tip holder 12 to support a spring 51.

Further, the barrel 10 has a first step 14 at a position around the tip holder 12. A second step 15 is provided at a position above the first step 14 to be axially spaced apart from the first step 14 by a predetermined distance.

A cartridge 50 is provided in the barrel 10. Since an end of the spring 51 is supported by a step 52*a* of a tip 52 through which ink is dispensed, and the other end of the spring 51 is supported by the step 12*a* of the tip holder 12, the cartridge 50 is elastically biased in a direction opposite to a direction of an outside force. A knock unit 60 is fitted over an upper portion of the cartridge 50.

The knock unit 60 has a hollow shape, and includes an upper end which is partially blocked, and a lower end which is completely opened. Two protrusions 61 and 62 are axially positioned on an outer circumferential surface of the knock unit 60 to be aligned in a row. In this case, the protrusions 61 and 62 are projected in a radial direction of the knock unit 60 while being spaced apart from each other by a distance corresponding to the layout of the half gear unit 300.

Further, openings 67 and support ribs 68 are provided at both sides on the circumference of the knock unit 60 to form a bridge structure. This minimizes consumption of material, and more efficiently supports the protrusions 61 and 62.

The first protrusion 61 of the knock unit 60 is relatively lower than the second protrusion 62 in projected height. Thus, the first protrusion 61 engages with a toothed part provided at an outer position of the half gear unit 300, distant from the rotating shaft, to perform sliding or stopping action, thus being involved in extension or retraction of the cartridge 50. The first protrusion 61 has a spirally inclined slide surface to correspond to first and second rotation guide parts that will be described later.

Further, the second protrusion 62 is higher than the first protrusion 61 in projected height. Thus, the second protrusion 62 engages with an inner portion near the rotating shaft of the half gear unit 300 to perform sliding or stopping action, thus being involved in extension or retraction of the cartridge 50. The second protrusion 62 has a spirally inclined slide surface to correspond to a third rotation guide part that will be described hereinafter.

Figure 10:
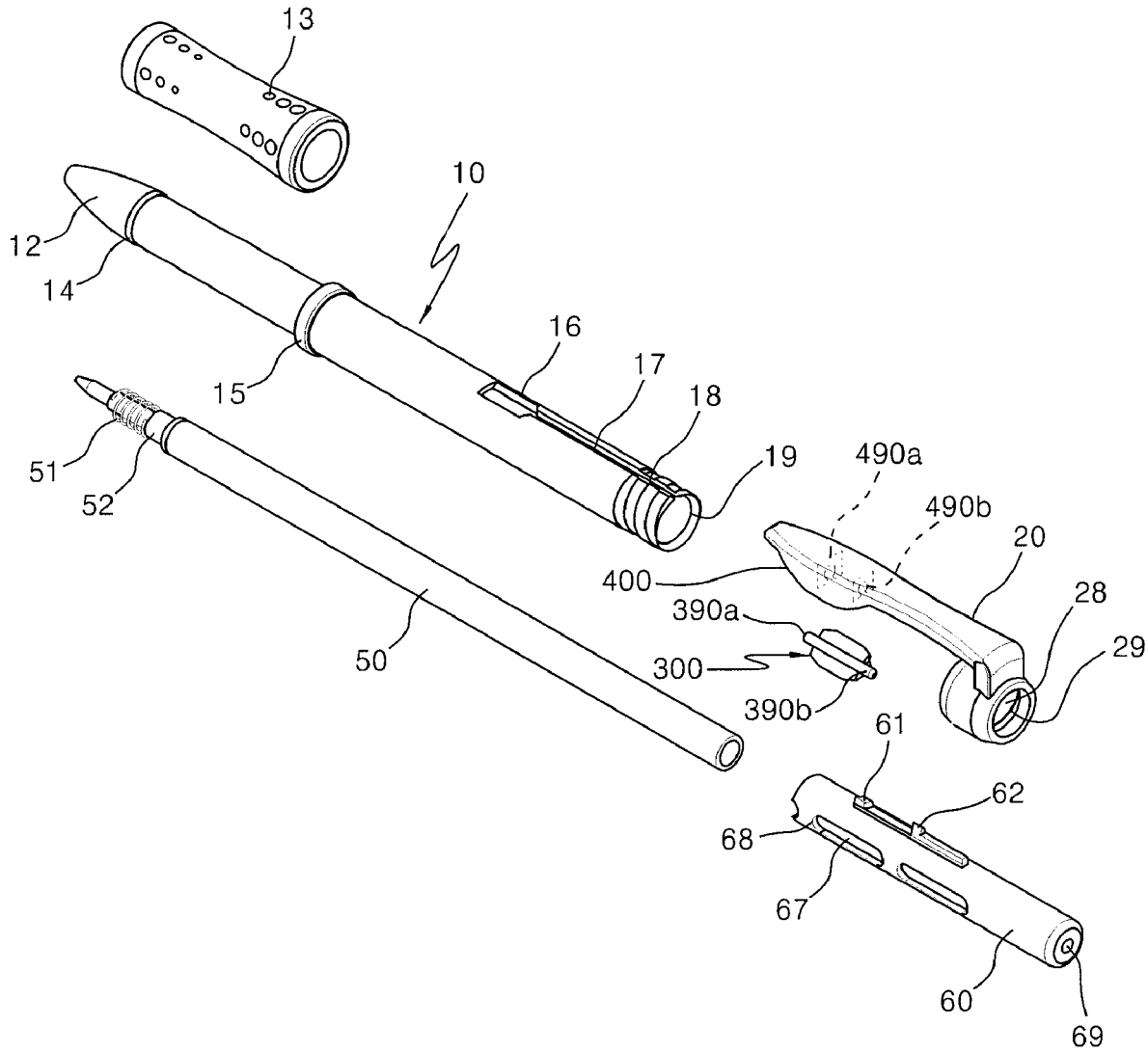
FIG. 10 is an exploded perspective view of the safety knock-type writing instrument, according to the second embodiment of the present invention.

As shown in FIG. 10, linear guide slits 16 and 17 which have predetermined lengths and are opened at a predetermined end are provided on the barrel 10 to be positioned between the half gear unit 300 and the knock unit 60, so that the first and second protrusions 61 and 62 axially slide along the guide slits 16 and 17 while being projected outside of the guide slit 16 and 17.

In this case, the predetermined end designates an upper end of the guide slits 16 and 17, and is opened while being coupled to an edge of a top opening of the barrel 10. The guide slits 16 and 17 comprise a wide opening 16 having a width corresponding to the half gear unit 300 so that the wide opening 16 is not affected by an operating area of the half gear unit 300, and a narrow opening 17 having a width corresponding to the first and second protrusions 61 and 62 so that the first and second protrusions 61 and 62 smoothly reciprocate.

Further, a first threaded part 18, such as an external thread, is provided on an outer circumferential surface of the upper end of the barrel 10. A second threaded part 28, such as an internal thread, is provided on an inner circumferential surface of a ring-shaped part of the clip 20 to engage with the first threaded part 18 (see, FIG. 9A or 9B).

A first tapered contact surface 19 is provided at a position around the open upper end of the barrel 10 to be tapered from a circular edge of the open upper end of the barrel 10 to a predetermined position around the first threaded part 18.

A second tapered contact surface 29 contacting the first tapered contact surface 19 is provided at an upper end of the second threaded part 28 on the inner circumferential surface of the ring-shaped part of the clip 20.

The first and second tapered contact surfaces 28 and 29 provide a relatively larger contact area, compared to a flat surface contact manner, thus generating a larger frictional force between the first and second tapered contact surfaces 28 and 29. Thereby, when the first threaded part 18 of the barrel 10 having the guide slits 16 and 17 engages with the second threaded part 28 of the clip 20, the first and second tapered contact surfaces 28 and 29 increase a coupling force between the first and second threaded parts 18 and 28, thus preventing durability of the writing instrument from being reduced due to the guide slits 16 and 17.

The first and second protrusions 61 and 62 are integrally provided on the outer circumferential surface of the knock unit 60 to be arranged in a row. The upper end of the knock unit 60 which is partially blocked has a push part in a button shape to extend and retract the cartridge 50, and an air hole 69 is provided at a predetermined position on the push part.

The coupling of the safety knock-type writing instrument and the shape of the half gear unit 300 according to the present invention are as follows.

A finger holder 13 is fitted over the barrel 10 to be positioned between the first and second steps 14 and 15.

The cartridge 50 having the tip 52 equipped with the spring 51 is inserted into the barrel 10 through the open upper end of the barrel 10.

The open lower end of the knock unit 60 is fitted over the cartridge 50 so that the knock unit 60 is positioned between the outer circumference of the cartridge 50 and the inner circumference of the barrel 10.

In this case, the knock unit 60 is inserted into the barrel 10 by a predetermined distance such that the first and second protrusions 61 and 62 are located at the guide slits 16 and 17.

Rotating shafts 390*a* and 390*b* of the half gear unit 300 are fitted into the corresponding shaft fitting members 490*a* and 490*b* of the gear seat 400 so that the gear unit 300 is rotatable within a predetermined angular range.

In the ring-shaped part of the clip 20, the first threaded part 18 of the barrel 10 engages with the second threaded part 28 of the clip 20. In this case, the push part provided at the upper end of the knock unit 60 passes through the upper end of the barrel 10 and the interior of the ring-shaped part of the clip 20 to be exposed to the outside.

The upper end of the cartridge 50 is in contact with an inner surface of the upper end of the knock unit 60, and the first and second protrusions 61 and 62 are located at initial positions which will be described below in detail. Further, whenever the user pushes the push part of the knock unit 60 having the air hole 69, the spring 51 generates restoring force acting against the user's force, and the restoring force is transmitted through the cartridge 50 to the knock unit 60 and the first and second protrusions 61 and 62.

That is, when the user applies finger's pressure to the push part, the knock unit 60 and the cartridge 50 rectilinearly reciprocate. The spring 51 is supported in the tip holder 12 and generates the restoring force to return the knock unit 60 and the cartridge 50 to original positions thereof. Further, the spring 51 functions to generate a force for rotating the half gear unit 30 within a predetermined angular range, in response to the linear reciprocating motion of the cartridge 50 or the knock unit 60.

In the safety-knock type writing instrument of the present invention, the half gear unit 300 requires a small installation space, thus allowing the construction of the clip 20 to be simple. Further, the first and second protrusions 61 and 62 of the knock unit 60 move while engaging with corresponding parts of the half gear unit 300, so that there is no loud tapping sound, but only a small friction noise is generated, thus achieving a writing instrument making little noise.

The above-mentioned features are accomplished by the half gear unit 300 described below in detail.

Figure 11A:
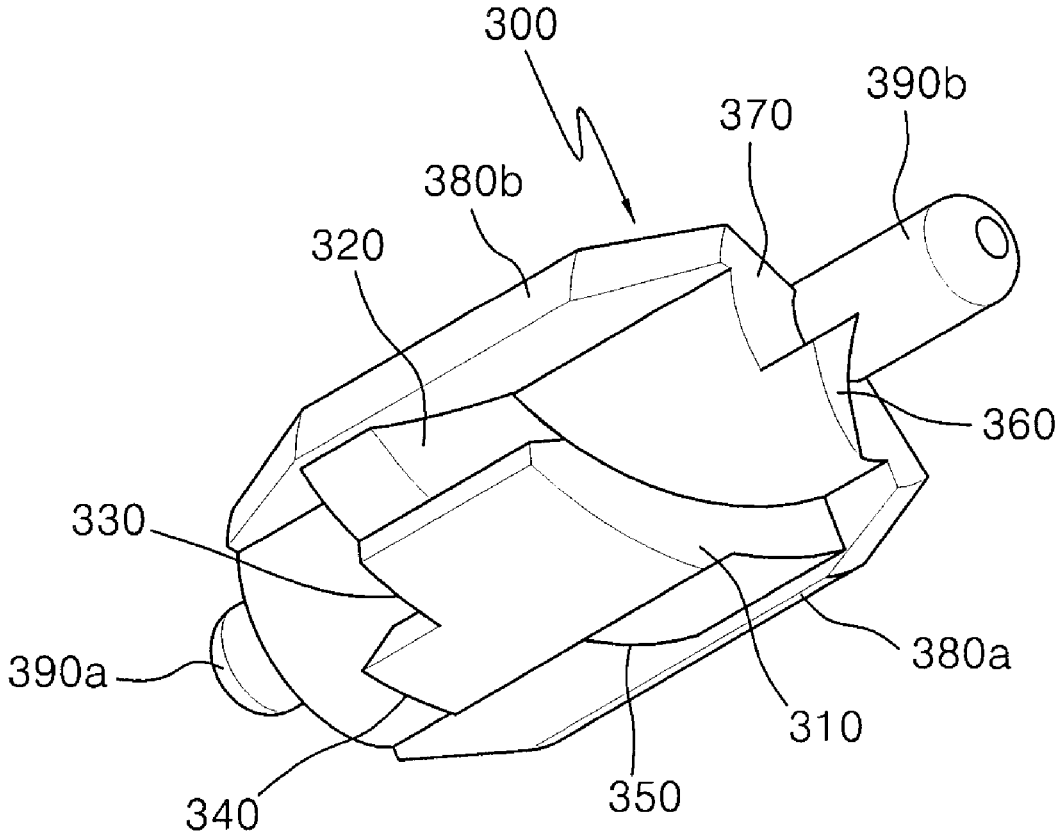
FIG. 11A is a front view to illustrate a half gear unit included in the writing instrument of FIG. 10.
Figure 11B:
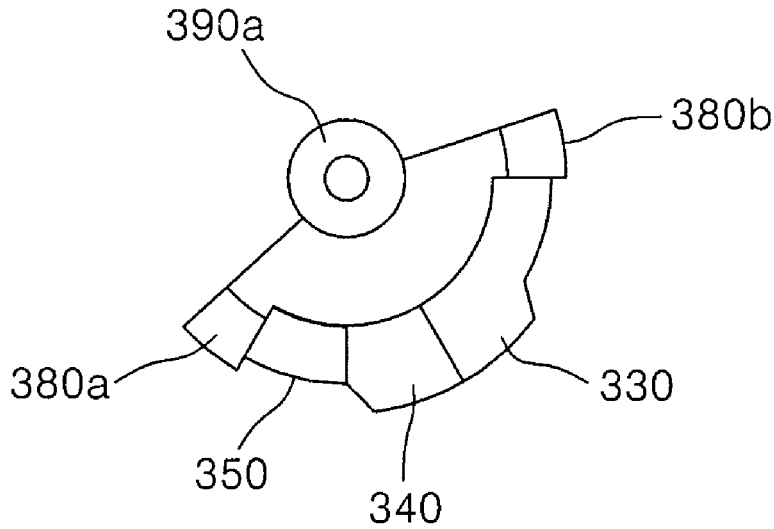
FIG. 11B is a left side view to illustrate the half gear unit included in the writing instrument of FIG. 10.
Figure 11C:
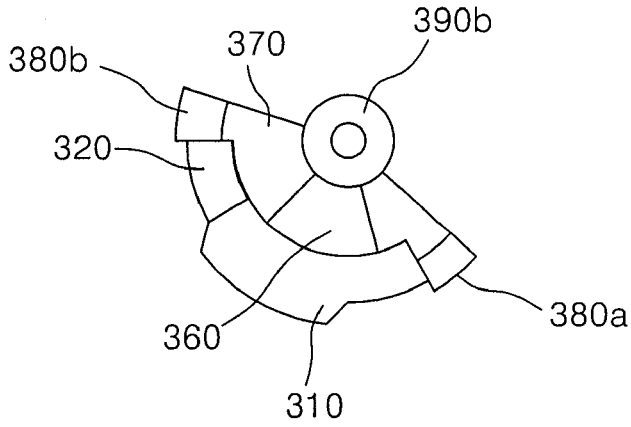
FIG. 11C is a right side view to illustrate the half gear unit included in the writing instrument of FIG. 10.

As shown in FIGS. 11A, 11B, and 11C, the half gear unit 300 includes the rotating shafts 390*a* and 390*b* which are projected in opposite directions, and a gear body having a shape of an eccentric gear which is constructed to be eccentric from a central axis of the rotating shaft.

The gear body having the shape of the eccentric gear includes a first rotation guide part 310, a first inclined groove part 320, a first protrusion seat 330, a second rotation guide part 340, a second inclined groove part 350, a third rotation guide part 360, a second protrusion seat 370, and first and second sidewalls 380*a* and 380*b*.

The first rotation guide part 310 provides a spirally inclined slide surface, and the first protrusion of the knock unit slides along the first rotation guide part to rotate the half gear unit within a predetermined angular range.

The first inclined groove part 320 is provided at a lower end of the inclined surface of the first rotation guide part 310 to form a linearly inclined slide surface and a flat surface in a direction of an axis of the rotating shafts 390*a* and 390*b*. The first inclined groove part 320 serves as a locking step using a height difference.

The first protrusion seat 330 is provided at an end of the flat surface of the first inclined groove part 320 to have a height different from the first inclined groove part 320. Further, the first protrusion seat 330 has a spirally inclined slide surface and a sharp corner, thus seating and stopping the first protrusion of the knock unit when the cartridge is extended.

The second rotation guide part 340 is provided above the sharp corner of the first protrusion seat 330, and has a toothed shape with a spirally inclined slide surface.

The second inclined groove part 350 is equal to the first inclined groove part 320, but has a linear inclined slide surface and a flat surface in an opposite direction to the first inclined groove part 320.

The third rotation guide part 360 provides a slide surface so that the second protrusion of the knock unit slides along the third rotation guide part, and is used to rotate the half gear unit within a predetermined angular range in an opposite direction to the above-mentioned rotating direction.

The second protrusion seat 370 functions as a stopper of the second protrusion of the knock unit.

The first and second sidewalls 380*a* and 380*b* have a shape of a hexagonal wing, and are provided outside the first and second inclined groove parts 320 and 350 to be perpendicular to the first and second inclined groove parts 320 and 350. In this case, the first and second sidewalls 380*a* and 380*b* function to guide and restrain the rotation of the first protrusion within a predetermined angular range.

The operation and use of the safety knock-type writing instrument of the present invention will be described in brief with reference to FIGS. 9A and 9B.

When the half gear unit 300 engages with the first protrusion 61, the cartridge is retracted into the barrel. In such a state, when a user pushes the push part of the knock unit 60 to extend the tip used to write, the first protrusion 61 disengages from the half gear unit 300, and simultaneously, the half gear unit 300 rotates by a predetermined angle in a predetermined direction. Thereafter, the first protrusion 61 comes into contact with the half gear unit 300 by the restoring force of the spring 51. At this time, the writing end of the tip 52 is extended out of the tip holder 12.

When the user finishes using the writing instrument, the user puts the clip 20 in his/her pocket without pushing the push part of the knock unit 60 to retract the cartridge 50. In this case, the first protrusion 61 disengages from the half gear unit 300, so that the cartridge 50 returns to an original position thereof by the restoring force of the spring 51, and thereby, the cartridge 50 is retracted into the barrel, thus preventing the user's clothing from being stained by the extended cartridge 50.

The operation of the half gear unit 30 and the knock unit 60 according to normal extension, normal retraction, safety retraction and normal extension of the tip of the cartridge will be described in detail with reference to FIGS. 12A to 15E.

First, the normal extension of the tip of the cartridge will be described with reference to FIGS. 12A to 12E.

Figure 12A:
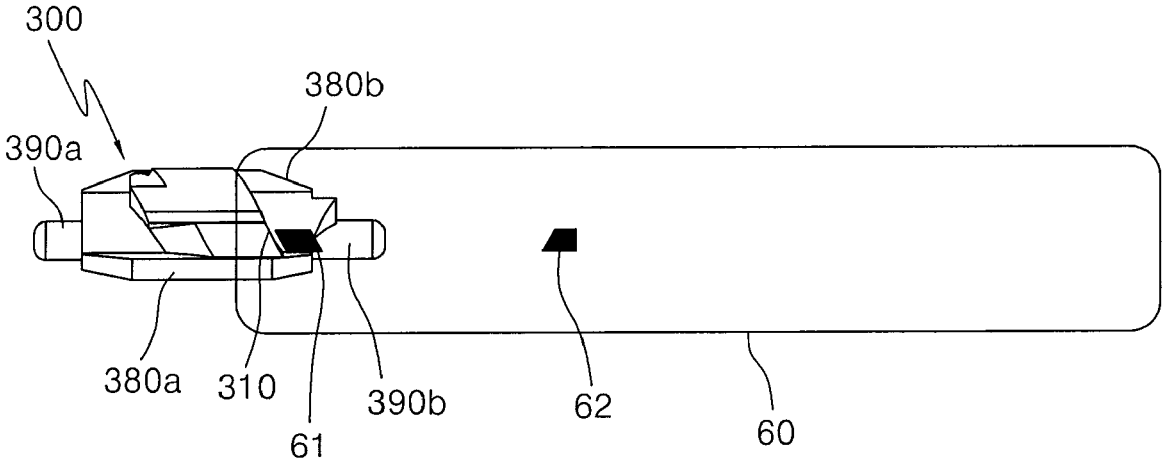
FIGS. 12A through 15E are views to illustrate operation of a knock unit of the writing instrument of FIG. 10.

As shown in FIG. 12A, in an initial state in which the cartridge is retracted, the first protrusion 61 of the knock unit 60 is relatively low, so that the first protrusion 61 is slidably in contact with the spirally inclined slide surface, and located at a corner between the first rotation guide part 310 and the first sidewall 380*a* of the half gear unit 300.

At this time, the second protrusion 62 is provided above the first protrusion 61 while being aligned in a row. The half gear unit 300 may rotate about the rotating shafts 390*a* and 390*b* within a predetermined angular range.

In order to normally extend the cartridge in such a state, the user pushes the push part of the knock unit 60.

Figure 12B:
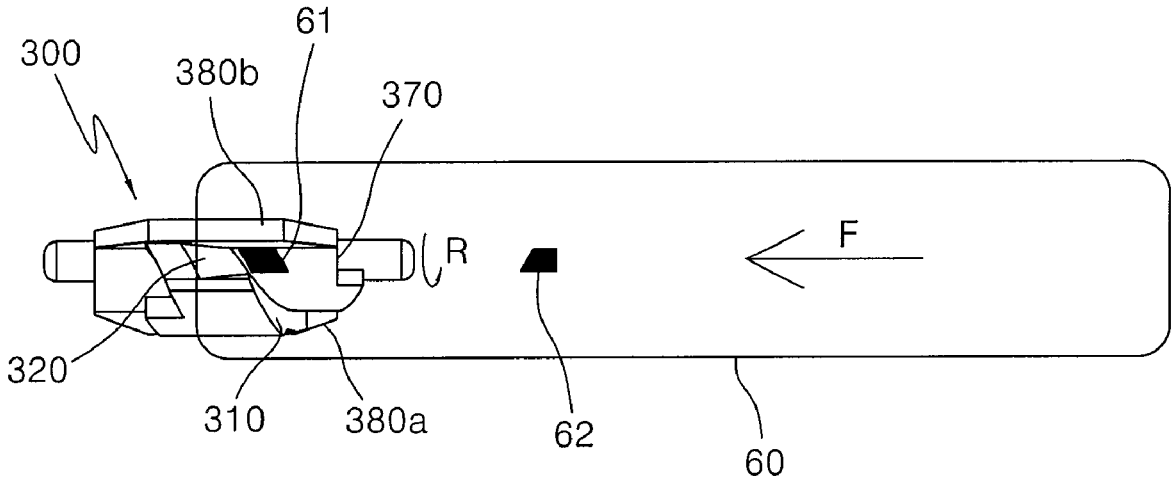

As shown in FIG. 12B, when the push part of the knock unit 60 is pushed to move the knock unit 60 in a pushing direction F, the first protrusion 61 of the knock unit 60 slidably comes into contact with the spirally inclined slide surface of the first rotation guide part 310 of the half gear unit 30 while moving in the same direction as the pushing direction F. The half gear unit 300 rotatably coupled to the first protrusion starts rotating within the predetermined angular range in a predetermined rotating direction R by the first rotation guide part 310.

When the first sidewall 380*a* of the half gear unit 300 comes into contact with the inner surface of the gear seat, the rotation of the half gear unit 300 stops. At this time, a corner between the second sidewall 380*b* of the half gear unit 300 and the first inclined groove part 320 comes into contact with the first protrusion 61 of the knock unit 60.

Since the user keeps pushing the knock unit 60 to a maximum moving position in the pushing direction F, the first protrusion 61 is guided by the second sidewall 380*b* to rectilinearly move along the slide surface and the flat surface of the first inclined groove part 320. At this time, the knock unit 60 horizontally supports the first protrusion 61 with respect to the cartridge, by the openings and the support ribs that form the bridge structure, as described above. Thus, the first protrusion 61 may move linearly while thrusting the first inclined groove part 320 in a projecting direction of the first protrusion 61.

In this case, a vertical force corresponding to a support force of the knock unit 60 is transmitted to the clip equipped with the half gear unit 300, so that the clip is slightly deformed within its elastic limits. Thereby, the clip slightly moves and then returns to an original position thereof, thus preventing the return of the first protrusion 61 to the first inclined groove part 320, and making the first protrusion 61 move along the slide surface of the first protrusion seat 330.

Figure 12C:
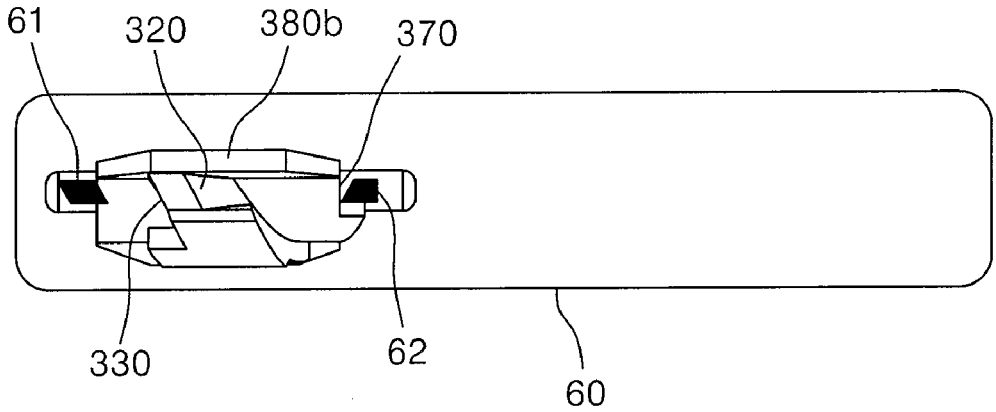

That is, as shown in FIG. 12C, when the first protrusion 61 of the knock unit 60 moves to the maximum moving position, the second protrusion 62 is relatively higher and comes into contact with the second protrusion seat 37. Therefore, the movement of the second protrusion 62 and the first protrusion 61 in the pushing direction F is stopped, and thereby, the knock unit 60 is not pushed any more.

Figure 12D:
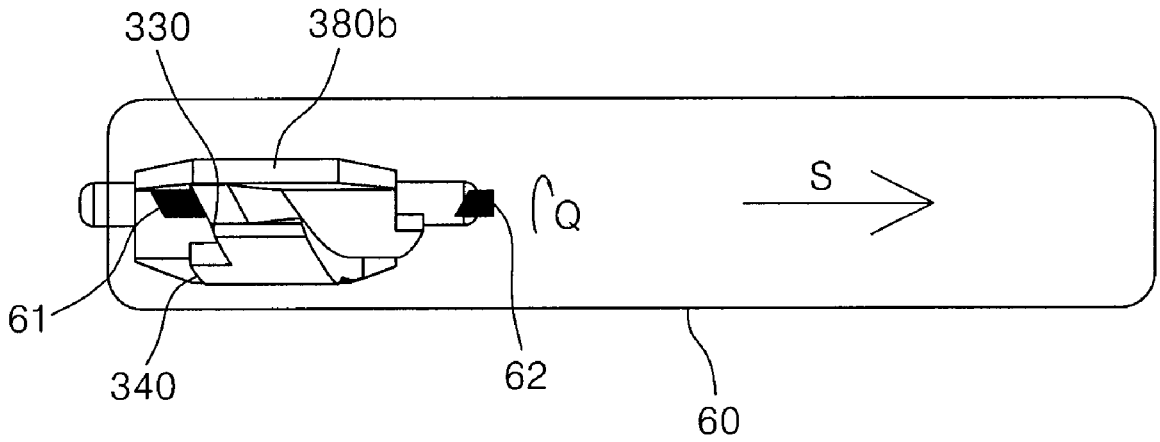

As shown in FIG. 12D, when the user's finger is released from the pushed knock unit 60, the knock unit 60 moves in a releasing direction S opposite to the pushing direction F, by the restoring force of the spring.

In this case, the slide surface of the first protrusion 61 comes into contact with the slide surface of the first protrusion seat 33, so that the half gear unit 300 starts rotating in an opposite rotational direction Q. Therefore, the first protrusion 61 is seated in the corner between the first protrusion seat 330 and the second rotation guide part 340. Thereby, the movement of the knock unit 60 in the releasing direction S and the rotation of the half gear unit 300 in the opposite rotational direction Q are stopped.

At this time, the slide surface of the second protrusion 62 is partially aligned with the slide surface of the third rotation guide part 360 in an imaginary straight line while being spaced apart from it. This is shown in FIG. 12E.

Figure 12E:
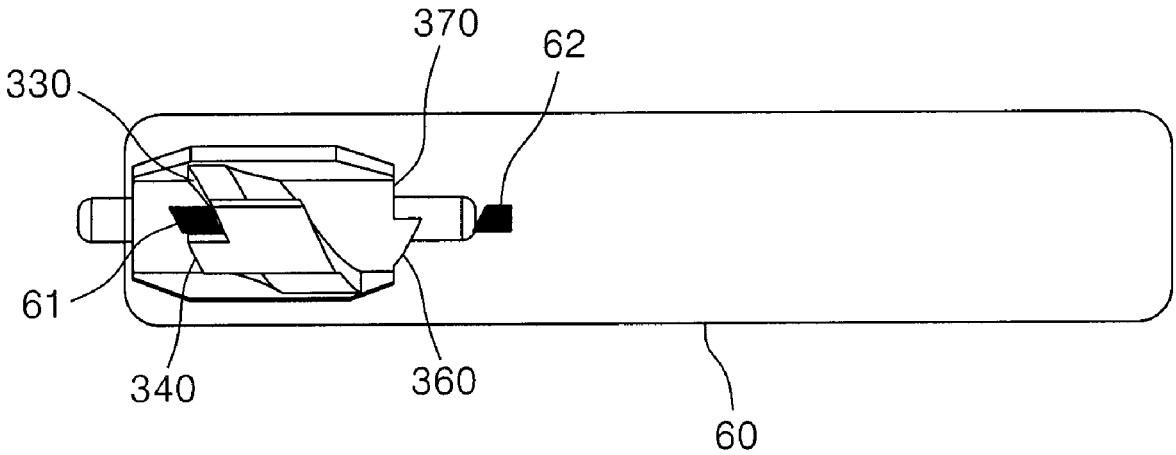

As shown in FIG. 12E, when the first protrusion 61 is seated in the first protrusion seat 330, the tip of the cartridge is extended, and the cartridge does not move upward by the engagement of the first protrusion 61 with the first protrusion seat 330, thus allowing the user to smoothly write using the writing instrument.

After using the writing instrument, the process of normally retracting the tip of the cartridge by pushing the knock unit 60 will be described with reference to FIGS. 13A to 13E.

Figure 13A:
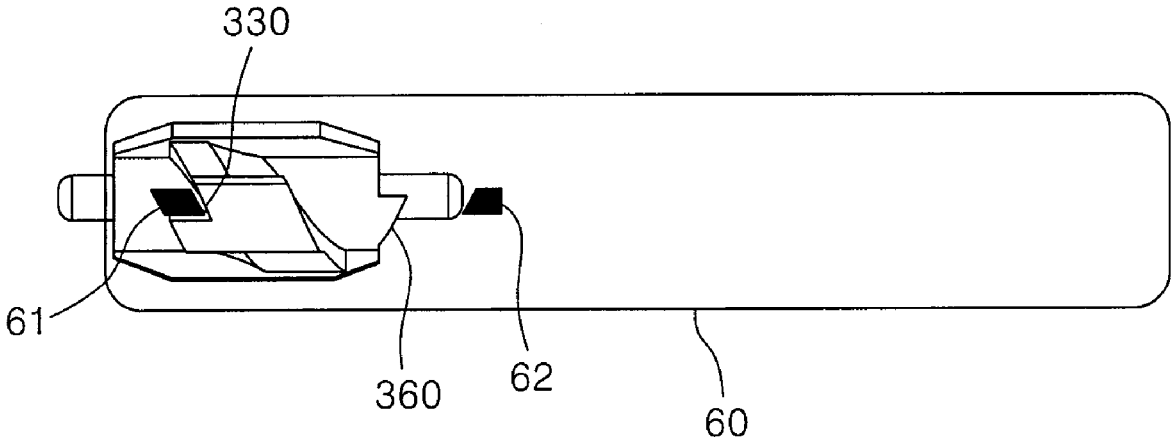

As shown in FIG. 13A, the first protrusion 61 is seated in the first protrusion seat 330, and the slide surface of the second protrusion 62 is partially aligned with the slide surface of the third rotation guide part 360 in an imaginary straight line while being spaced apart from it. Further, a part of the tip is extended out of the tip holder.

Figure 13B:
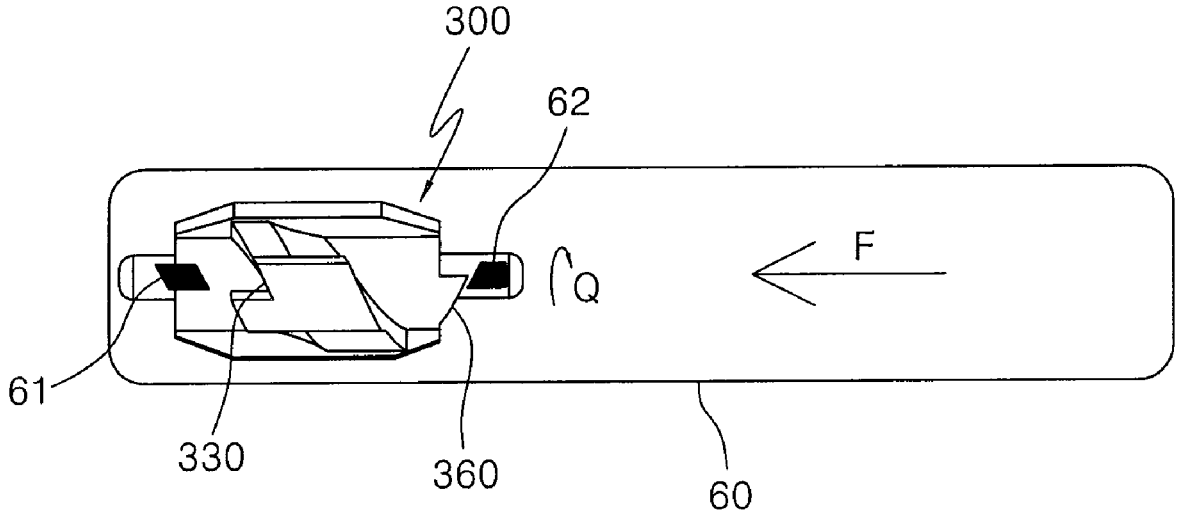

As shown in FIG. 13B, in order to normally retract the cartridge in the above-mentioned state, the push part of the knock unit 60 is pushed, and simultaneously, the knock unit 60 moves in the pushing direction F. At this time, the first protrusion 61 of the knock unit 60 disengages from the first protrusion seat 330, so that rotation of the half gear unit 300 is possible.

At the same time, the slide surface of the second protrusion 62 slidably comes into contact with the slide surface of the third rotation guide part 360, and thereby, the half gear unit 300 rotates in the opposite rotational direction Q by a contact distance between the slide surface of the second protrusion and the slide surface of the third rotation guide part. This is shown in FIG. 13C.

Figure 13C:
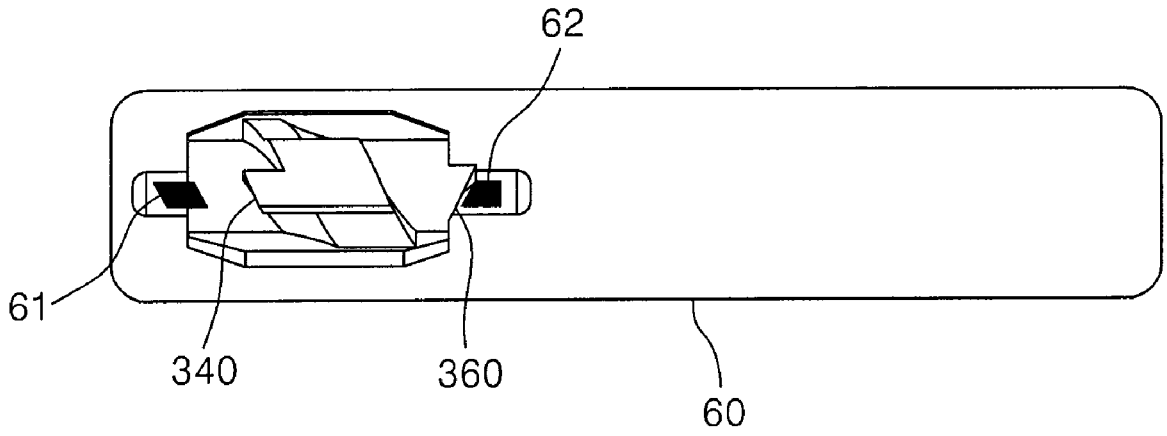

As shown in FIG. 13C, the slide surface of the first protrusion 61 of the knock unit 60 is positioned to be spaced apart from the slide surface of the second rotation guide part 340, and the second protrusion 62 moves along the slide surface of the third rotation guide part 360 to be in surface contact therewith.

Figure 13D:
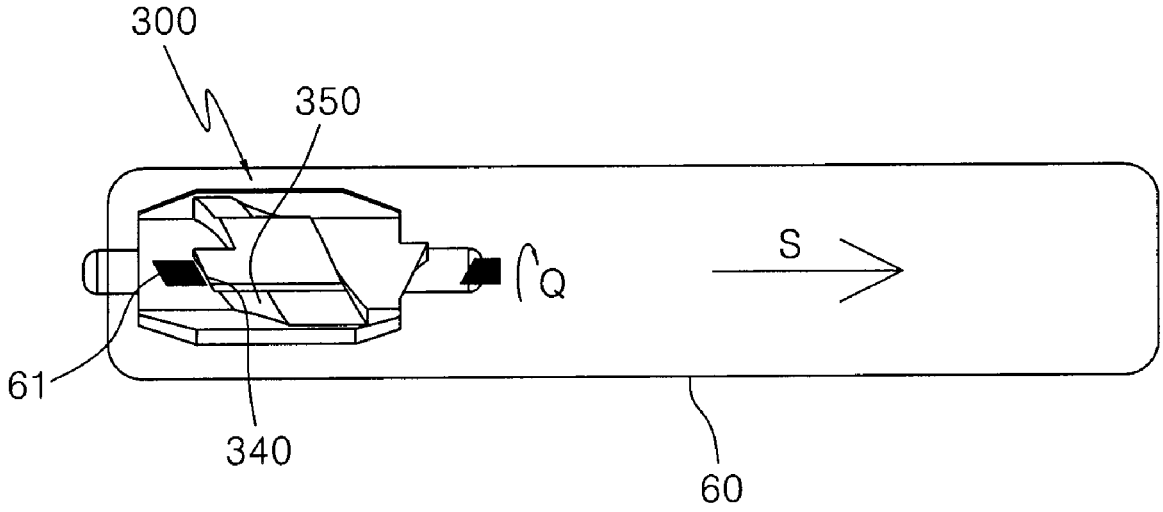

As shown in FIG. 13D, when the user's finger is released from the pushed knock unit 60, the knock unit 60 moves in the releasing direction S due to the restoring force of the spring.

In this case, when the slide surface of the first protrusion 61 comes into contact with the slide surface of the second rotation guide part 340, the half gear unit 300 keeps rotating in the opposite rotational direction Q, corresponding to the slant direction of the slide surfaces.

Figure 13E:
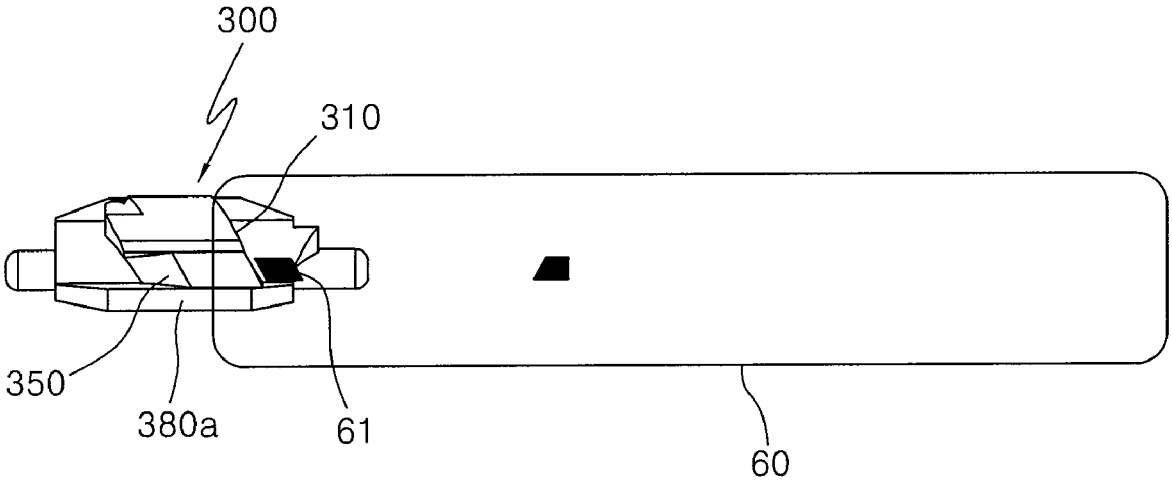

Therefore, as shown in FIG. 13E, the first sidewall 380*a* supported by the inner surface of the gear seat comes into contact with the first protrusion 61, thus stopping the rotation of the half gear unit 300 in the opposite rotational direction Q.

Due to the elastic force of the spring, the first protrusion 61 passes over the linearly inclined slide surface and the flat surface of the second inclined groove part 350, thus returning to the original position thereof.

At this time, as described above, the clip equipped with the half gear unit 300 moves slightly due to the vertical force corresponding to the support force of the knock unit 60, and then returns to the original position.

Thus, the return of the first protrusion 61 to the second inclined groove part 350 is restrained, so that the first protrusion 61 may move along only the first rotation guide part 310.

Therefore, the half gear unit 300 does not rotate in only a predetermined rotating direction different from a prior art, but rotates in the rotating direction R and the opposite rotational direction Q to correspond to the reciprocating motion of the knock unit 60 in the pushing direction F and the releasing direction R. Thus, the extension of the tip of the cartridge coupled to the knock unit 60 is performed and stopped stepwise, so that the sound is very quiet.

The safety retraction of the cartridge will be described with reference to FIGS. 14A and 14B. Such a process is executed to retract the cartridge, when the writing instrument is put, with the cartridge extended, in a user's pocket, without pushing the knock unit 60 to retract the cartridge.

Figure 14A:
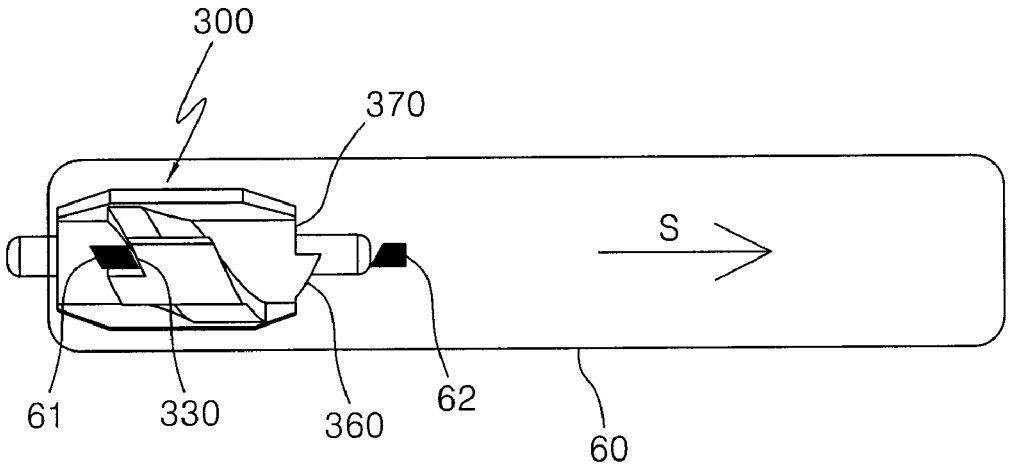

When the user puts the writing instrument, with the cartridge extended as shown in FIG. 14A, in his/her pocket, a predetermined portion of the clip having the gear seat moves away from the barrel.

Thus, the first protrusion seat 330 of the half gear unit 300 is removed from the first protrusion 61 of the knock unit 60, or the first protrusion 61 of the knock unit 60 disengages from the first protrusion seat 330 of the half gear unit 300, so that axial movement of the cartridge and the knock unit 60 is possible.

Figure 14B:
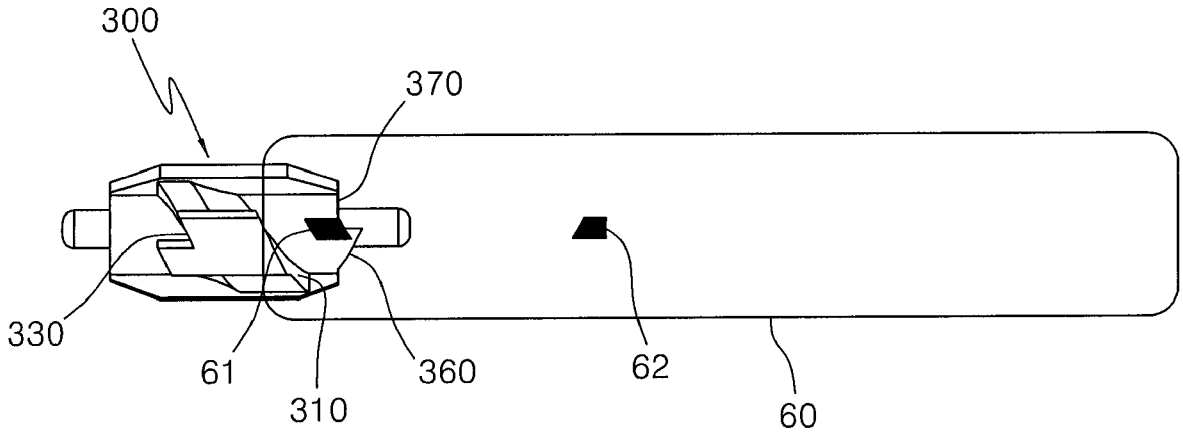

In this case, as shown in FIG. 14B, the cartridge is retracted by the restoring force of the spring, and the knock unit 60 coupled to the cartridge immediately moves in the releasing direction S.

At this time, rotation of the half gear unit 300 does not occur, but the second protrusion 62 moves upward to be positioned above either the third rotation guide part 360 or the second protrusion seat 370. Simultaneously, the first protrusion 61 is located at a position on a surface between the third rotation guide part 360 and the first rotation guide part 310 of the half gear unit 300.

Thus, although the user puts the writing instrument, with the cartridge extended, in his/her pocket, the cartridge is automatically retracted by the action of the half gear unit 300 and the knock unit 60.

The process of extending the retracted cartridge will be described below with reference to FIGS. 15A to 15E.

The normal extension of FIGS. 15A to 15E which is executed after the safety retraction is very similar to the normal extension of the tip of the cartridge which is shown in FIGS. 12A to 12E.

Figure 15A:
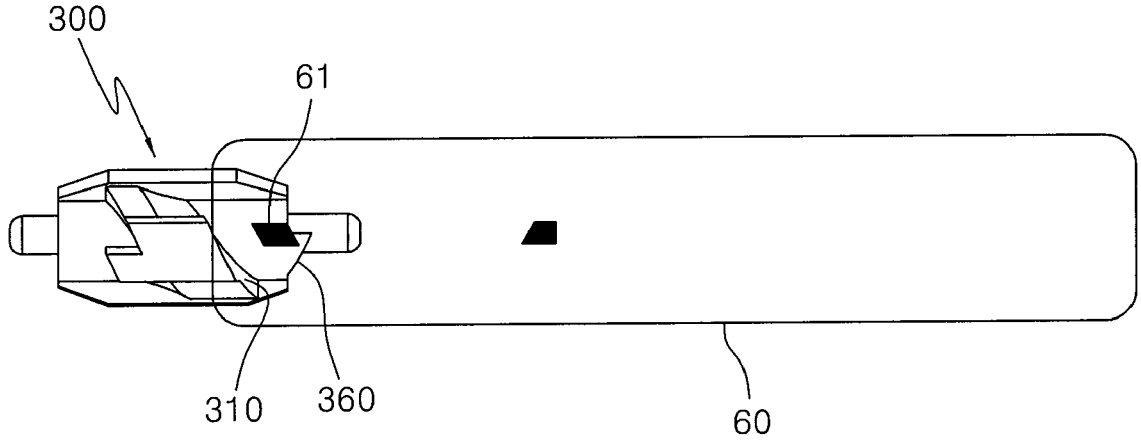

That is, when the cartridge is retracted as shown in FIG. 15A, the first protrusion 61 of the knock unit 60 is stopped at a predetermined position on the surface of the half gear unit 300 between the third rotation guide part 360 and the first rotation guide part 310. In order to normally extend the cartridge in such a state, the user pushes the push part of the knock unit 60.

Figure 15B:
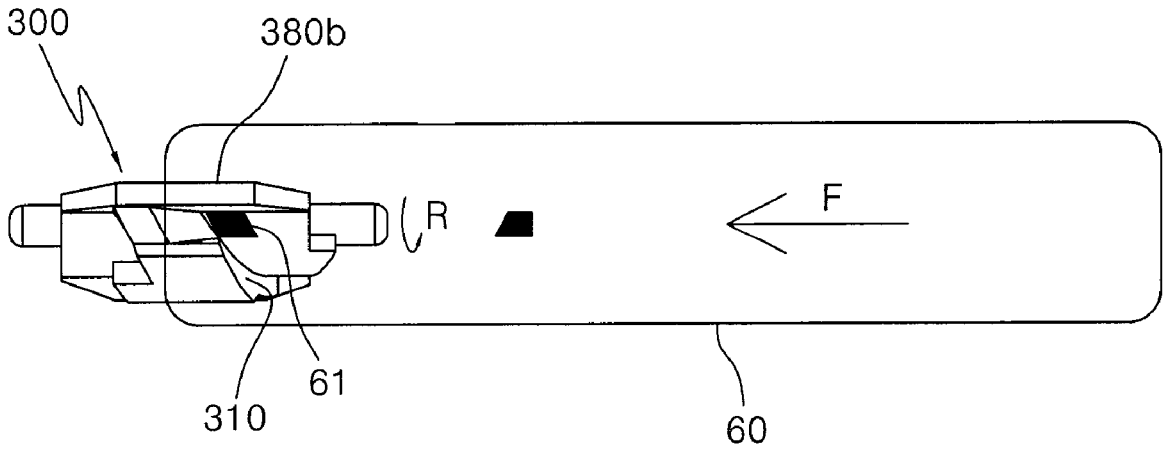

In this case, as shown in FIG. 15B, the first protrusion 61 of the knock unit 60 moves in the pushing direction F, so that the half gear unit 300 rotates within the predetermined angular range in the rotating direction R. Thus, the corner between the first rotation guide part 310 of the half gear unit 300 and the first sidewall 380*b* comes into contact with the first protrusion 61 of the knock unit 60.

Figure 15C:
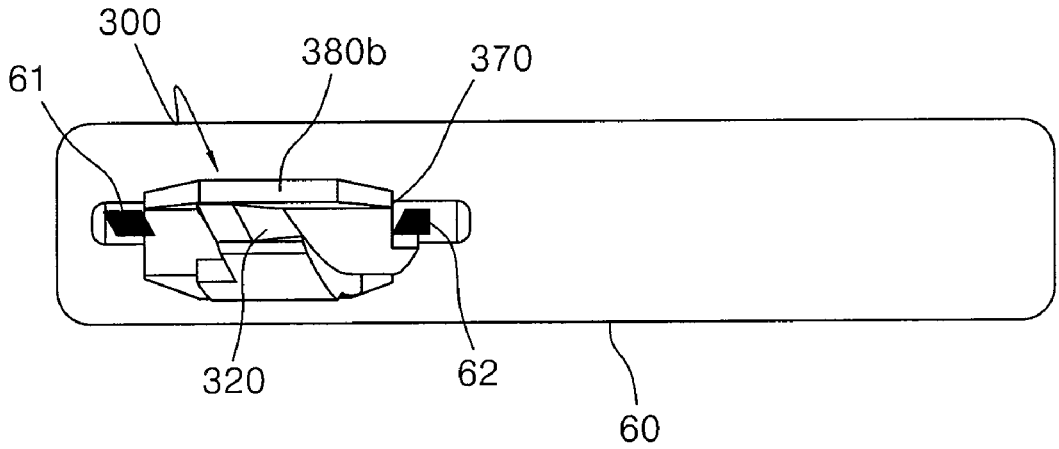

As shown in FIG. 15C, when the user pushes the knock unit 60 to the maximum moving position in the pushing direction F, the first protrusion 61 is guided by the second sidewall 380*b* to pass over the first inclined groove part 320, but is stopped together with the knock unit 60 and the second protrusion 62 by the second protrusion 62 coming into contact with the second protrusion seat 370.

Figure 15D:
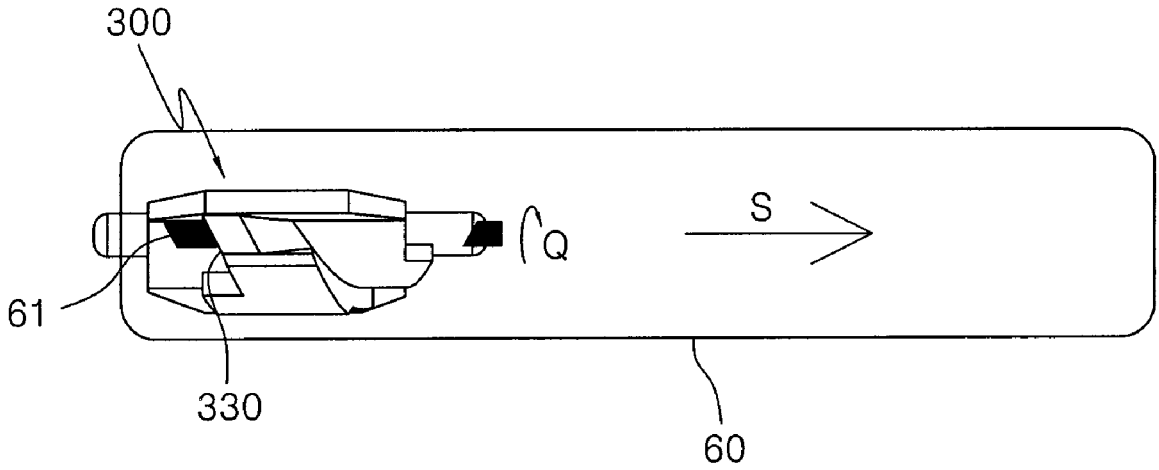

As shown in FIG. 15D, when the user's finger is released from the pushed knock unit 60, the knock unit 60 moves in the releasing direction S by the restoring force of the spring, so that the first protrusion 61 of the knock unit 60 comes into contact with the slide surface of the first protrusion seat 330.

Figure 15E:
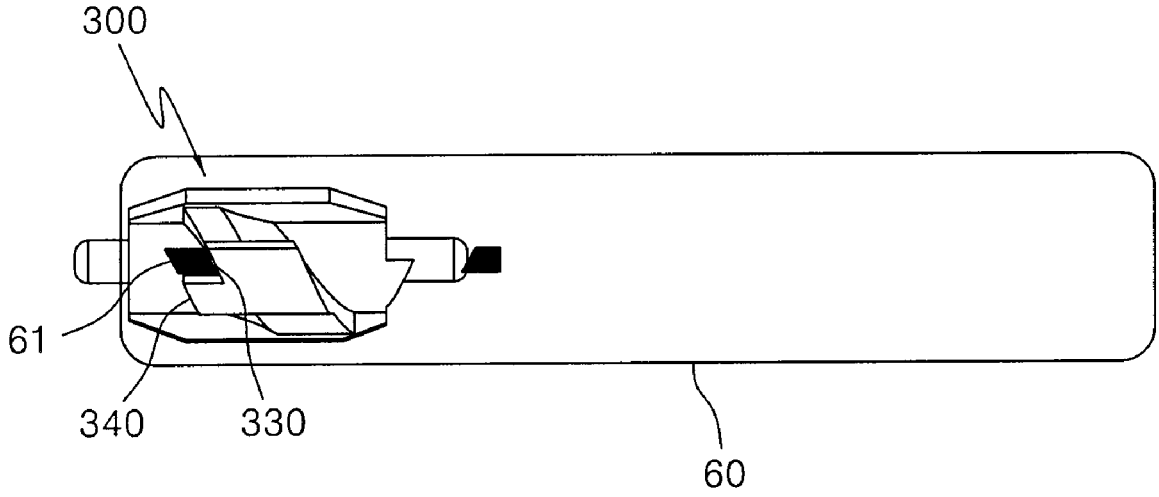

As shown in FIG. 15E, the half gear unit 300 rotates in the opposite rotational direction Q, in response to the movement of the first protrusion 61 of the knock unit 60, so that the sharp corner provided between the first protrusion seat 330 and the second rotation guide part 340 restrains the linear movement of the first protrusion 61. In this case, the tip of the cartridge is extended out of the tip holder, thus allowing the user to write using the writing instrument.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A safety knock-type writing instrument, comprising:

a barrel having a cartridge therein;

a half gear unit provided on an exterior of the barrel and rotatably seated in a clip, wherein the half gear unit has a shape of an eccentric gear which rotates about a central axis thereof, and comprises:

a first rotation guide part providing a spirally inclined slide surface so that the first protrusion of the knock unit slides along the first rotation guide part to rotate the half gear unit within a predetermined angular range;

a first inclined groove part provided at a lower end of an inclined surface of the first rotation guide part to form a linearly inclined slide surface and a flat surface in a direction of an axis of rotating shafts, the first inclined groove part serving as a locking step using a height difference;

a first protrusion seat provided at an end of the fiat surface of the first inclined groove part to have a height different from the first inclined groove part, the first protrusion seat having a spirally inclined slide surface and a sharp corner, thus seating and stopping the first protrusion when the cartridge is extended;

a second rotation guide part provided above the sharp corner of the first protrusion seat, and having a toothed shape with a spirally inclined slide surface;

a second inclined groove part which is the equal to the first inclined groove part, but has a linear inclined slide surface and a flat surface in an opposite direction to the first inclined groove part;

a third rotation guide part having a slide surface so that the second protrusion of the knock unit slides along the third rotation guide part;

a second protrusion seat to function as a stopper of the second protrusion; and first and second sidewalls provided outside the first and second inclined groove parts to be perpendicular to the first and second inclined groove parts, the first and second sidewalls guiding and restraining the rotation of the first protrusion within the predetermined angular range; and a knock unit positioned in the barrel, and including first and second protrusions to engage with the half gear unit;

wherein the cartridge is retracted into the barrel when the first protrusion of the knock unit disengages from the half gear unit; and the half gear unit rotates in a rotating direction and an opposite rotational direction (Q), in response to reciprocating motion of the knock unit in a pushing direction (F) and a releasing direction (R).

2. The safety knock-type writing instrument according to claim 1, wherein the barrel is formed so that a barrel body is integrated with a tip holder into a single structure, and comprises linear guide slits having a wide opening and a narrow opening, respectively, the linear guide slits having a predetermined length and being opened at a predetermined end so that the first and second protrusions axially slide along the linear guide slits while being projected out of the linear guide slits.

3. The safety knock-type writing instrument according to claim 1, wherein the barrel is coupled to a ring-shaped part of the clip by engagement of a first threaded part of the barrel with a second threaded part of the clip.

4. The safety knock-type writing instrument according to claim 1, wherein the barrel has a first tapered contact surface at a position around the first threaded part, and the ring-shaped part of the clip has a second tapered contact surface to be in frictional contact with the first tapered contact surface, the first and second tapered contact surfaces providing a relatively large contact area compared to a flat surface contact manner, thus increasing a coupling force when the first threaded part of the barrel having the guide slits engages with the second threaded part of the clip.

* * * * *